US005784664A

United States Patent [19]

Nakamura et al.

[11] Patent Number: 5,784,664

[45] Date of Patent: Jul. 21, 1998

[54] IMAGE FORMING APPARATUS HAVING AN IMAGE FORMATION SUPERVISING CONTROLLER AND METHOD FOR SUPERVISING IMAGE FORMING OPERATIONS

[75] Inventors: Hidenobu Nakamura; Tomokazu Kato, both of Toyokawa; Tomoyuki Atsumi, Toyohashi; Hiroyuki Asai, Okazaki, all of Japan

[73] Assignee: Minolta Co., Ltd., Osaka, Japan

[21] Appl. No.: 881,026

[22] Filed: Jun. 23, 1997

[30] Foreign Application Priority Data

Jun. 25, 1996 [JP] Japan ..... 8-163980

[51] Int. Cl.[6] ..... G03G 15/00

[52] U.S. Cl. ..... 399/8; 399/80

[58] Field of Search ..... 399/8, 9, 79, 80

[56] References Cited

FOREIGN PATENT DOCUMENTS 6-187061 7/1994 Japan .

*Primary Examiner*—Joan H. Pendegrass

*Attorney, Agent, or Firm*—Sidley & Austin

[57] ABSTRACT

A copier supervisory control system in which a plurality of copiers are connected to each other over a network is provided. Each of the plurality of copiers has a structure that compares a user identifier inputted by a user with a registered identifier. If the user identifier and the registered identifier are identical, the user is permitted to make copies by the copier. If the two compared identifiers are not identical, the user is prohibited from making copies. More specifically, a first copier receives a user identifier and compares it with its registered identifier. If the user identifier and the registered identifier of the first copier are not identical, the copier inquires of a second copier whether it has a registered identifier identical to the user identifier over the network. Upon receipt of the inquiry, the second copier compares the user identifier with its own identifier, and if the two identifiers are identical, it informs the first copier of the result over the network. Upon receipt of the information, the first copier permits the user to make copies.

16 Claims, 21 Drawing Sheets

IMAGE FORMING APPARATUS HAVING AN IMAGE FORMATION SUPERVISING CONTROLLER AND METHOD FOR SUPERVISING IMAGE FORMING OPERATIONS

BACKGROUND OF THE INVENTION

1. Field of the Invention

The present invention relates to an image forming apparatus that allows a user to use the apparatus when a user identifier inputted by the user is identical to a registered identifier of the apparatus. The present invention also relates to an image formation supervisory control method used in an image formation supervisory control system in which a plurality of such image forming apparatuses are connected to each other over a network.

2. Related Art

Image forming apparatuses, such as copying machines for business use, are installed in various places in one firm, while one copying machine is often shared by a plurality of sections in the firm. In such a case, it is desirable to prevent outsiders from using the copying machines and to supervise each section on the number of copies for cost-saving purpose. In a recent copying machine of this type, an image forming operation is allowed only when an identification number inputted upon starting the copying operation is identical to an identification number registered beforehand.

When making a copy by a copying machine which supervises image forming operations with identification numbers, however, a user has to go to a copying machine provided with the user's section identification number, because the user cannot use another copying machine provided with a different identification number even if it is the nearest one to the user. If the user still tries to use the nearest copying machine, he/she has to register his/her section identification number in that copying machine. The registering will become troublesome especially when the number of copying machines which the user intends to use is large.

If the user registers his/her identification number in a plurality of copying machines, counting the number of copies made by each section will become complicated, because it will be necessary to check all the copying machines for the identification number of each section.

SUMMARY OF THE INVENTION

The principal object of the present invention is to provide an image formation supervisory control system in which image forming operations can be performed by any image forming apparatus in the system, without registering a section ID every time an image forming operation is performed, as long as the section ID is registered in one of the image forming apparatuses in the system.

The above object can be achieved by providing an image forming apparatus comprising: an identifier receiving unit for receiving a first user identifier inputted by a user; an identifier storage unit for storing a first registered identifier under which image forming operations are permitted; a judging unit for permitting the user to use the image forming apparatus if the first user identifier inputted by the user is identical to the first registered identifier stored in the identifier storage unit, and prohibiting the user from using the image forming apparatus of the first user identifier is not identical to the first registered identifier; a communication unit for communicating with another image forming apparatus; an inquiry unit for making a first inquiry, via the communication unit, as to whether the first user identifier is identical to a second registered identifier of another image forming apparatus, if the first user identifier is not identical to the first registered identifier; and a switching unit for switching the judging unit from "prohibition" to "permission" if another image forming apparatus has informed that the first user identifier is identical to the second registered identifier, or that the user is permitted to use the image forming apparatus that has made the first inquiry. Such an image forming apparatus further comprises: a receiving unit for receiving a second inquiry from another image forming apparatus, via the communication unit, as to whether a second user identifier inputted to the image forming apparatus is identical to the first registered identifier; a searching unit for searching the identifier storage unit for the second user identifier; and a transmitting unit for transmitting a response, via the communication unit, to the image forming apparatus that has made the second inquiry, so as to inform that the second user identifier has been found, or that the user is permitted to use the image forming apparatus that has made the second inquiry when the second user identifier has been found in the identifier storage unit.

The object of the present invention can also be achieved by providing an image formation supervisory control system in which a plurality of image forming apparatuses are connected to each other over a network. Each of the plurality of image forming apparatuses includes a judging unit which compares a user identifier inputted by a user with a registered identifier stored in an identifier storage unit of the image forming apparatus beforehand. The judging unit permits the user to use the apparatus when the user identifier is identical to the registered identifier, and prohibits the user from using the apparatus when the user identifier is not identical to the registered identifier. Each image forming apparatus comprises at least a first image forming apparatus for inquiring of another image forming apparatus whether the user identifier is registered, and a second image forming apparatus for responding to the inquiry. The first image forming apparatus comprises: a first communication unit for communicating with the second image forming apparatus over the network; an inquiry unit for inquiring of the second image forming apparatus, via the first communication unit, whether the inputted user identifier is identical to a registered identifier of the second image forming apparatus in the case where the judging unit has made a judgement that the inputted user identifier is not identical to the registered identifier of the first image forming apparatus; and a switching unit for switching the judgement of the judging unit to allowing the user an image forming operation in the case where the first image forming apparatus receives a response informing that the registered identifier of the second image forming apparatus is identical to the user identifier, or that the user is allowed to use the first image forming apparatus. The second image forming apparatus comprises: a second communication unit for communicating with the first image forming apparatus over the network; a receiving unit for receiving an inquiry from the first image forming apparatus, via the second communication unit, as to whether the user identifier transmitted from the first image forming apparatus is identical to the registered identifier of the second image forming apparatus; a searching unit for searching the identifier storage unit of the second image forming apparatus for the inquired user identifier; and a transmitting unit for transmitting a response, via the second communication unit, to the first image forming apparatus to inform that the inquired user identifier is identical to the registered identifier of the second image forming apparatus, or that the user is allowed to use the first image forming apparatus.

The above object of the present invention can also be achieved by an image formation supervisory control method used in an image formation supervisory control system in which a plurality of image forming apparatuses are connected to each other over a network. Each of the plurality of image forming apparatuses includes a judging unit which compares a user identifier inputted by a user with a registered identifier stored in an identifier storage unit of the apparatus beforehand. The judging unit allows the user to use the apparatus when the user identifier is identical to the registered identifier, and prohibits the user from using the apparatus when the user identifier is not identical to the registered identifier. Such an image formation supervisory control method comprises the steps of; (1) inquiring whether any other image forming apparatus has a registered identifier identical to a user identifier inputted to a first image forming apparatus, when the user identifier is not identical to the registered identifier of the first image forming apparatus; (2) comparing the user identifier with a registered identifier of a second image forming apparatus that has received the inquiry over the network; (3) transmitting a response informing the first image forming apparatus that the user identifier is identical to the registered identifier of the second image forming apparatus or that the user is allowed to use the first image forming apparatus; and (4) switching the image forming status of the first image forming apparatus to allowing image forming operations after the first image forming apparatus has received the response over the network.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings.

DESCRIPTION OF THE PREFERRED EMBODIMENTS

The following is an explanation of an embodiment of the present invention. In this embodiment, a plurality of copying machines are connected to a copying machine supervisory control system.

Figure 1:
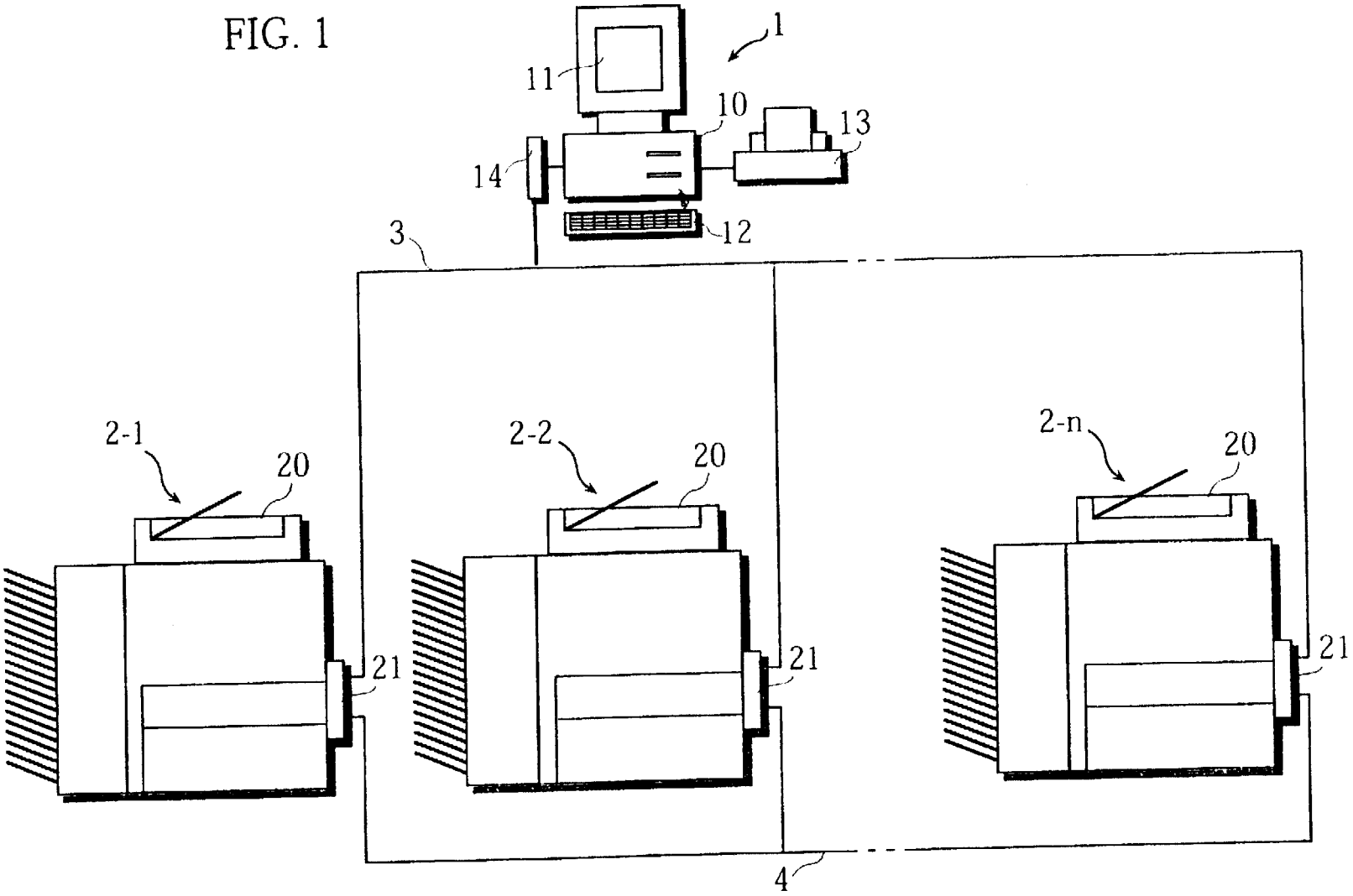
FIG. 1 shows the overall structure of an image formation control system of the present invention.

FIG. 1 shows the overall structure of the copying machine control system of this embodiment.

The copying machine control system comprises a host computer 1 provided at a service center and a plurality of user copying machines 2-1 to 2-n provided on each floor of the building or for each section of an office.

The host computer 1 comprises a mainframe 10, a display 11, a keyboard 12, a printer 13, and a modem 14.

Each of the copying machines 2-1 to 2-n includes a main body 20 and a modem unit 21.

The modem 14 and the modem unit 21 of each of the copying machines 2-1 to 2-n are connected by means of a telephone line 3. The modems 21 are connected by means of a private line 4.

Each of the copying machines 2-1 to 2-n is provided with identification numbers (hereinafter referred to as "ID") in a memory in the copying machine's main body 20 beforehand, so that the number of copies made by each section can be counted using the registered IDs. An operation panel OP is provided on the copying machine's main body 20 at its fore side.

Figure 2A:
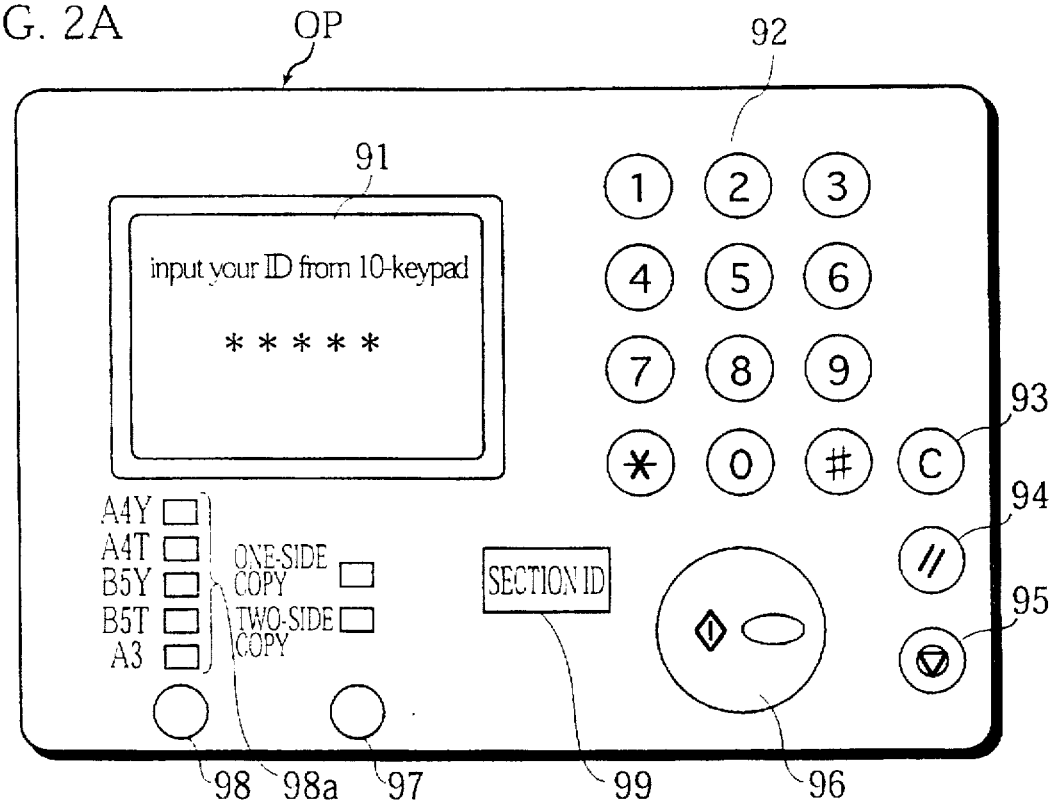
FIGS. 2A and 2B are front views of the operation panel.
Figure 2B:
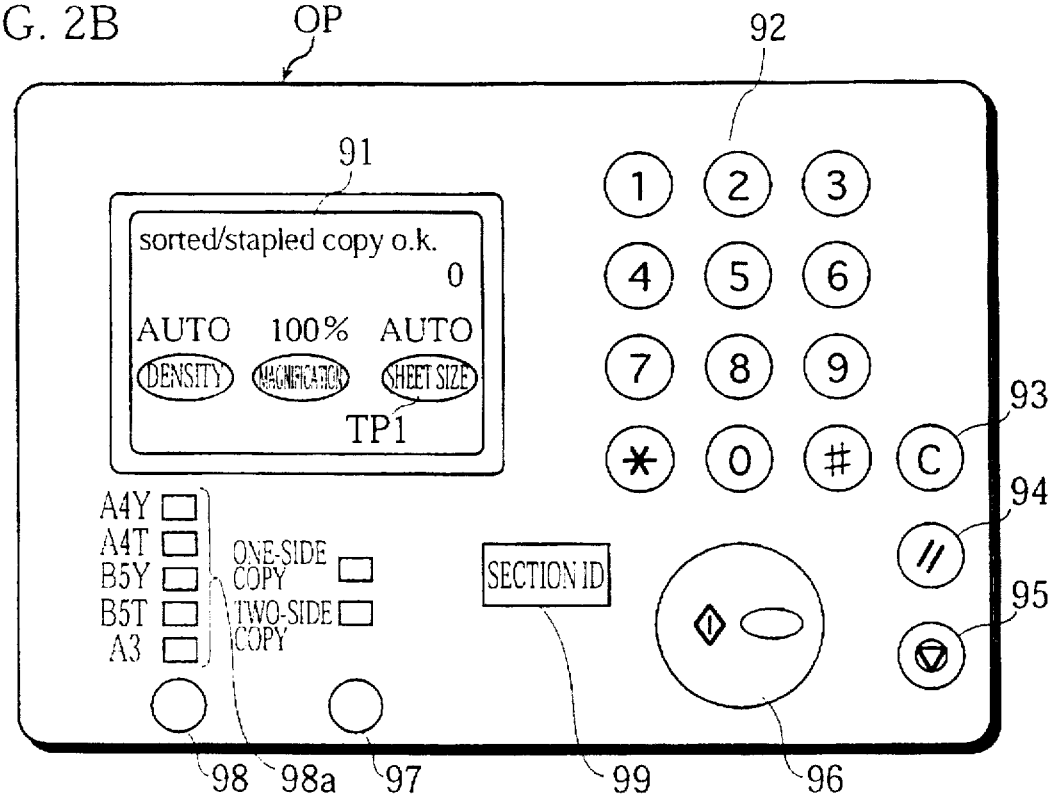

FIGS. 2A and 2B are front views showing the structure of the operation panel OP.

The operation panel OP includes a liquid crystal touch panel 91, a 10-keypad 92 for inputting the number of copies to be made and magnification, a clear key 93 for resetting the number of copies to the initial value "1", a panel reset key 94 for resetting set values inside the copying machine's main body 20 to initial values, a stop key 95 for stopping copying, a start key 96 for starting copying, a mode setting key 97 for setting a copy mode, a sheet size select key 98 for selecting the sheet size, a sheet size indicating unit **98*a* for indicating the selected sheet size, and a section ID setting key 99** for setting a section ID inputted from the operation panel OP prior to copying.

The liquid crystal touch panel 91 is formed by laminating a touch panel for receiving key input using the keys displayed on the liquid crystal display on a liquid crystal display for displaying various guide messages and various keys. The liquid crystal touch panel 91 indicates that the copying machine is under section supervision in the initial state by displaying the message "input your ID from 10-keypad" as shown in FIG. 2A.

A user inputs the ID of the section to which he/she belongs from the 10-keypad and then press the section ID setting key 99. If the section ID inputted from the operation panel OP has been registered in the copying machine, the liquid crystal touch panel 91 of the copying machine indicates that copying is allowed by displaying the message "sorted/stapled copy O.K.".

Here, the user can set various conditions such as the number of copies, copy magnification, sheet size, and copy density, by pressing the respective keys, and then the user can start copying by pressing the start key 96.

The sheet size can also be selected through the liquid crystal touch panel 91 by pressing a sheet size select button TP1 so as to switch to a sheet size select display. Here, an LED indicating the selected sheet size on the sheet size indicating unit 98*a* lights up.

As for the sheet size indicators 98*a*, "B5T" stands for B5 size sheets placed longitudinally in parallel with the transport direction, for instance, while "A4Y" stands for A4 size sheets placed transversely.

Figure 3:
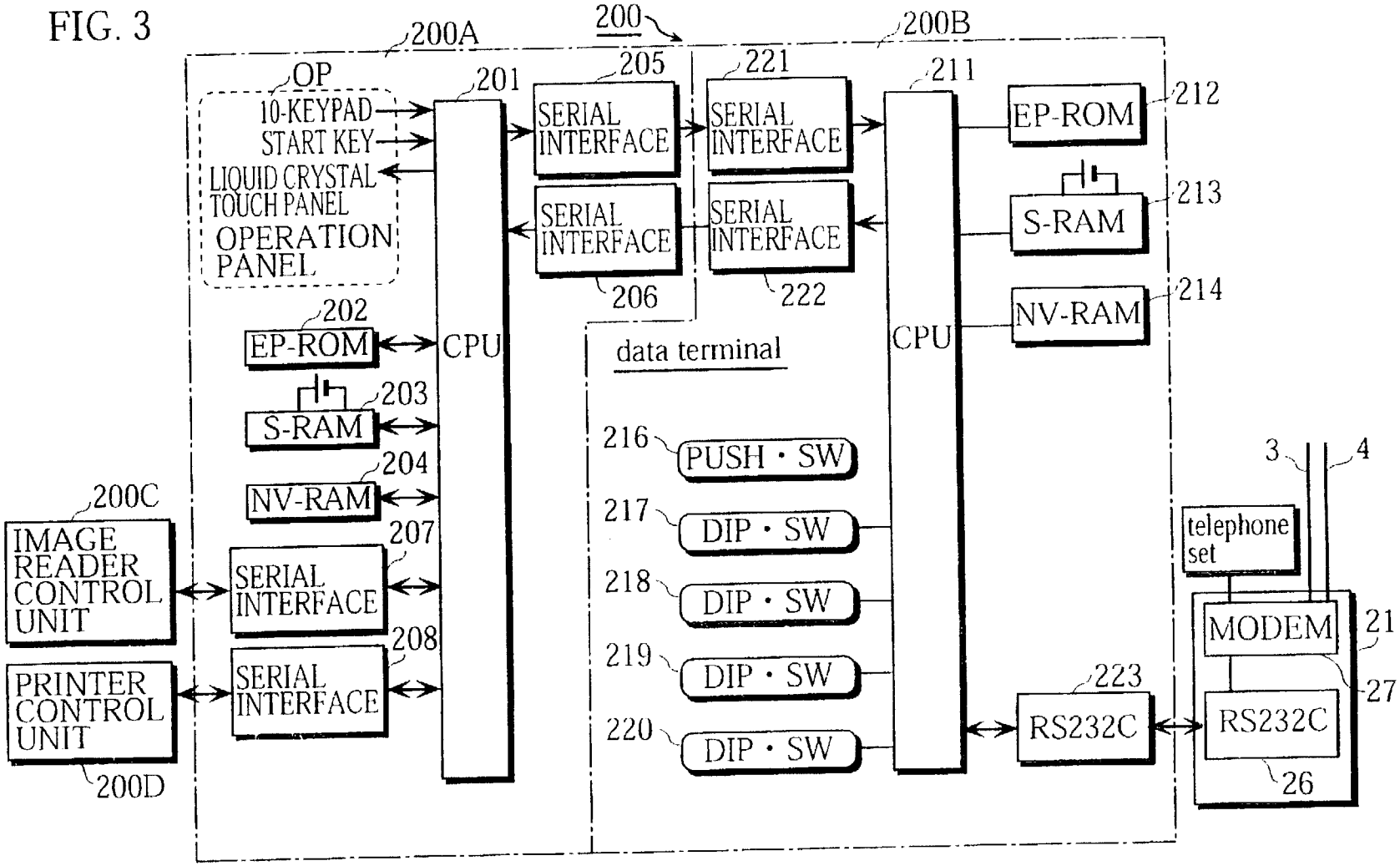
FIG. 3 is a block diagram showing the structure of the control unit provided in the main body of the copying machine.

FIG. 3 is a block diagram showing the structure of the control unit 200 provided in the copying machine's main body 20.

The control unit 200 includes an operation panel control unit 200A, a data terminal control unit 200B, an image reader control unit 200C, and a printer control unit 200D.

The communication between the operation panel control unit 200A and the data terminal control unit 200C is conducted via serial interfaces 205 and 206, and serial interfaces 221 and 222.

The communication between the operation panel control unit 200A and the image reader control unit 200B is conducted via a serial interface 207, while the communication between the operation panel control unit 200A and the printer control unit 200D is conducted via a serial interface 208.

EP-ROMs 202 and 212 store basic programs essential to the control operations by CPUs 201 and 211, respectively. The CPUs 201 and 211 each reads out the program when necessary, and controls each unit according to the program. Battery-backed S-RAMs 203 and 213 each stores instructions from the user and operation status of each unit, and sends them to the CPUs 201 and 211, respectively.

The operation panel control unit 200A controls the display on the liquid crystal touch panel 91 of the operation panel OP, and transmits input data such as a section ID to another control unit.

The EP-ROM 202 stores a panel display program for switching display images on the liquid crystal touch panel 91, while an NV-RAM 204 stores image data in the above-mentioned section supervision display mode and the standard display mode.

Upon switching on the main body 20 of the copying machine, the image data of the section supervision display mode are read from the NV-RAM 204, and the section supervision image is displayed on the liquid crystal touch panel 91 as shown in FIG. 2A to show that inputting a section ID is allowed.

The user inputs the section ID from the 10-keypad 92 and presses the section ID setting key 99, so that the inputted section ID is transmitted to the data terminal control unit 200B according to the program in the EP-ROM 202.

The data terminal control unit 200B judges whether a section ID inputted from the operation panel OP is a registered ID or not, counts the number of copies made in each registered section, and communicates with the host computer 1 and other copying machines via the modem unit 21.

Upon receipt of a response to allow copying from the data terminal control unit 200B, the image data of the standard display mode are read from the NV-RAM 204, and the standard display image shown in FIG. 2B is displayed on the liquid crystal touch panel 91 to indicate that copying is allowed.

For instance, the operation panel control unit 200A controls the liquid crystal touch panel 91 so as to display the list of the sheet sizes stored in the NV-RAM 204 in the form of the standard display image according to the panel display program in the EP-ROM 202. The user selects one of the sheet sizes in the list, and then the operation panel control unit 200A informs the printer control unit 200D of the selected sheet size via the serial interface 208 and also stores the information into the S-RAM 203.

The modem unit 21 consisting of a modem 27 connected to the public telephone line 3 and the private line 4, and an RS232C interface 26 connected to an RS232C interface 223 of the data terminal control unit 200B. Thus, the data terminal control unit 200B conducts the data communication between the copying machine and another copying machine via the private line 4 as well as the data communication between the copying machine and the host computer 1 via the public telephone line 3.

The EP-ROM 212 stores a program for supervising the registered sections and the number of copies made by each registered section, a program for judging whether a section ID inputted from the operation panel OP is identical to one of the registered section ID, and a program for asking whether any other copying machine holds a registered section ID identical to the inputted section ID via the modem unit 21.

The NV-RAM 214 stores the identification number allotted to the copying machine in use (hereinafter referred to as "machine ID") as well as the data of the machine IDs of the other copying machines and the telephone number of the host computer 1.

The setting of the machine ID to the copying machine in use is conducted using dip switches 217 to 220. A user inputs a code number allotted to the copying machine through the dip switches 217 to 220, and presses a push switch 216, so that the CPU 211 reads the values from the dip switches 217 to 220 and stores them into the NV-RAM 214 as the machine ID of the copying machine.

Setting machine IDs for other copying machines and setting a telephone number for the host computer 1 are conducted in the same manner as described above. Here, the machine IDs of the copying machines 2-1 to 2-n are PPCID1 to PPCIDn, respectively.

The S-RAM 213 contains a number storage area for storing various numbers which are used as standards for copying cost calculated by the host computer 1 and for maintenance. It also contains a work area for inquiring of other copying machines according to a communication program.

The copying cost is calculated based on the total number of discharged sheets, each type of used sheets, and the number of copies made by each section. The maintenance is conducted based on the number of jams which have occurred in each part of the copying machine, the number of failures which have occurred to each part, and the number of times each part has been used.

Figure 4A:
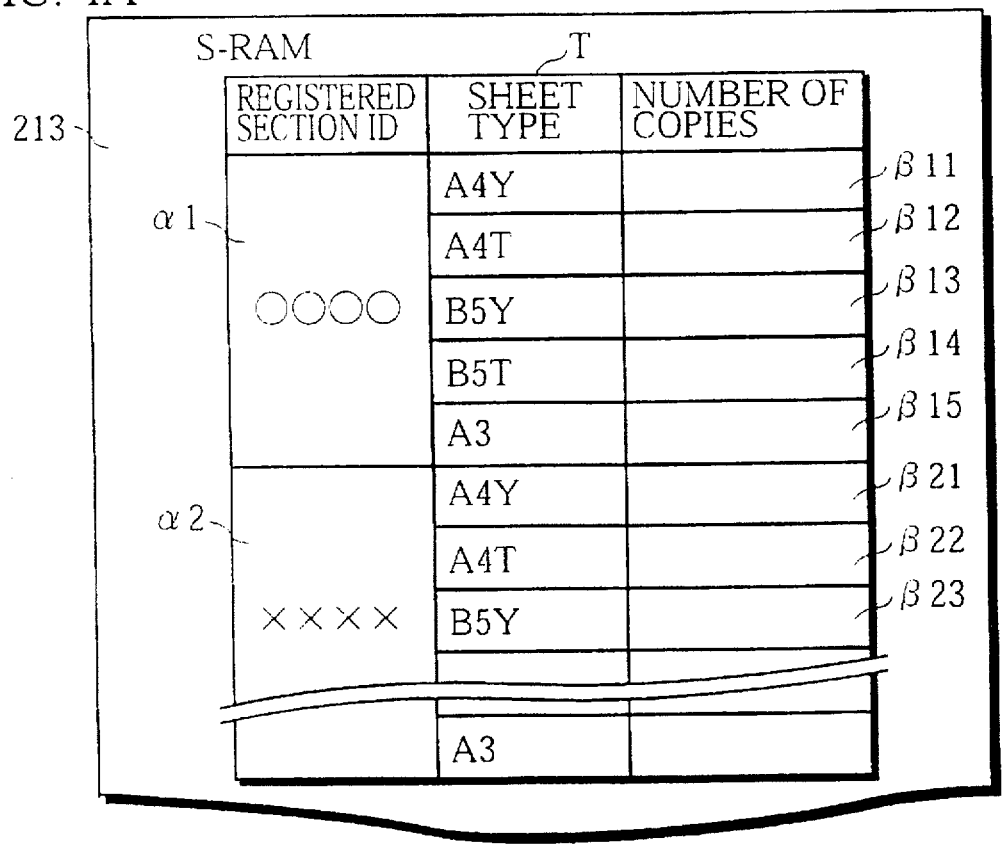
FIGS. 4A and 4B are example memory contents of S-RAM of FIG. 3.
Figure 4B:
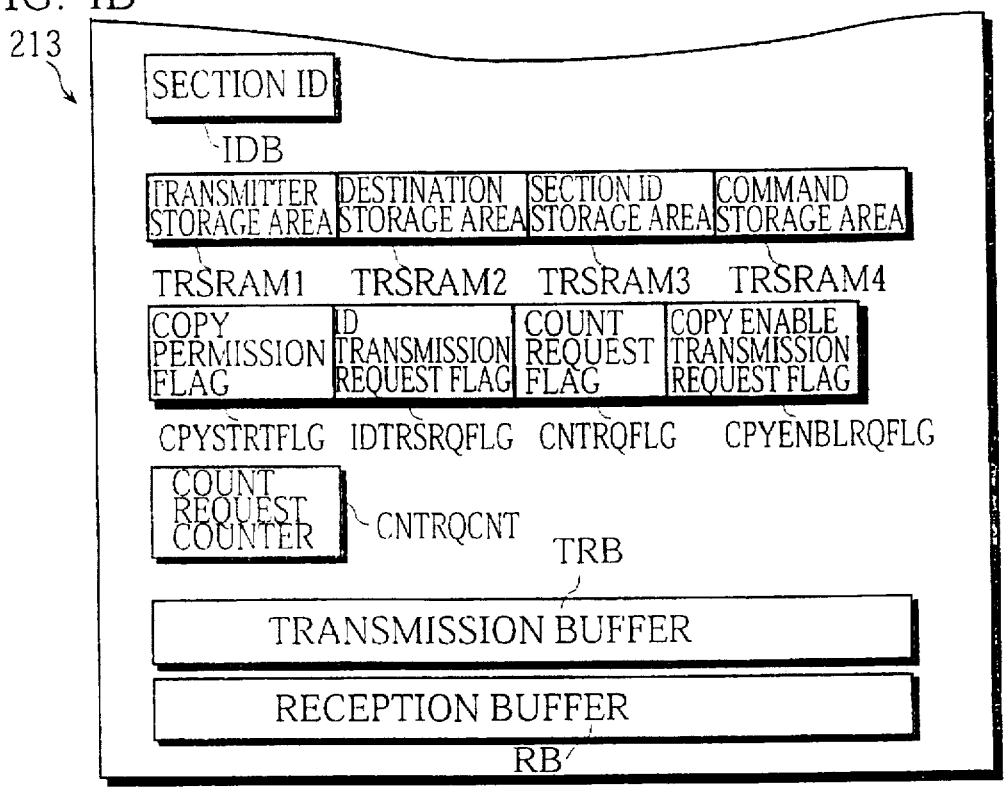

FIGS. 4A and 4B show an example of memory content of the S-RAM 213. FIG. 4A is a supervisory table T for storing and counting the number of copies made in each section, while FIG. 4B shows a work area for communication.

The supervisory table T includes registered section ID storage areas α1, α2, . . . for storing a plurality of registered section IDs of the sections which are allowed to use the copying machine, and copy number storage areas β11 to β15, β21 to β23 . . . for storing the number of copies of each sheet type made by each section. A registered section ID can be set in the same manner as in setting the machine ID to the copying machine. Specifically, a user inputs the code number allotted to the section through the dip switches 217 to 220, and stores them into the registered section ID storage area of the S-RAM 213.

The work area of the S-RAM 21.3 includes: a section ID buffer IDB for temporarily storing section IDs inputted from the operation panel control unit 200A; a transmitter storage area TRSRAM1 for storing the ID of a copying machine making inquiries; a destination storage area TRSRAM2 for storing the ID of a destination copying machine; a section ID storage area TRSRAM3 for storing section IDs; a command storage area TRSRAM4 for storing a copy permission command or a count request command; a copy permission flag CPYSTRTFLG for indicating whether copying is permitted with the copying machine; an ID transmission request flag IDTRSRQFLG for showing whether the machine ID is to be set in the destination storage area TRSRAM2; a count request flag CNTRQFLG for showing whether a count request command is to be set in the command storage area TRSRAM4; a copy permission transmission request flag CPYENGLRQFLG for showing whether a copy permission command is to be set in the command storage area TRSRAM4; a count request counter CNTRQCNT for storing the number of copies made by other copying machines; a transmission buffer TRB for storing the contents of the transmitter storage area TRSRAM1, the destination storage area TRSRAM2, the section ID storage area TRSRAM3, and the command storage area TRSRAM4, when communicating with other copying machines; and a reception buffer RB for storing data received from other copying machines.

When the conditions for calling another copying machine are satisfied, the data terminal control unit 200B activates the modem 27 to connect the present copying machine to another copying machine via the private line 4. Three stages shown in FIG. 5, an inquiry stage (1), a response stage (2), and a copy number informing stage (3), are then performed in that order.

Figure 5:
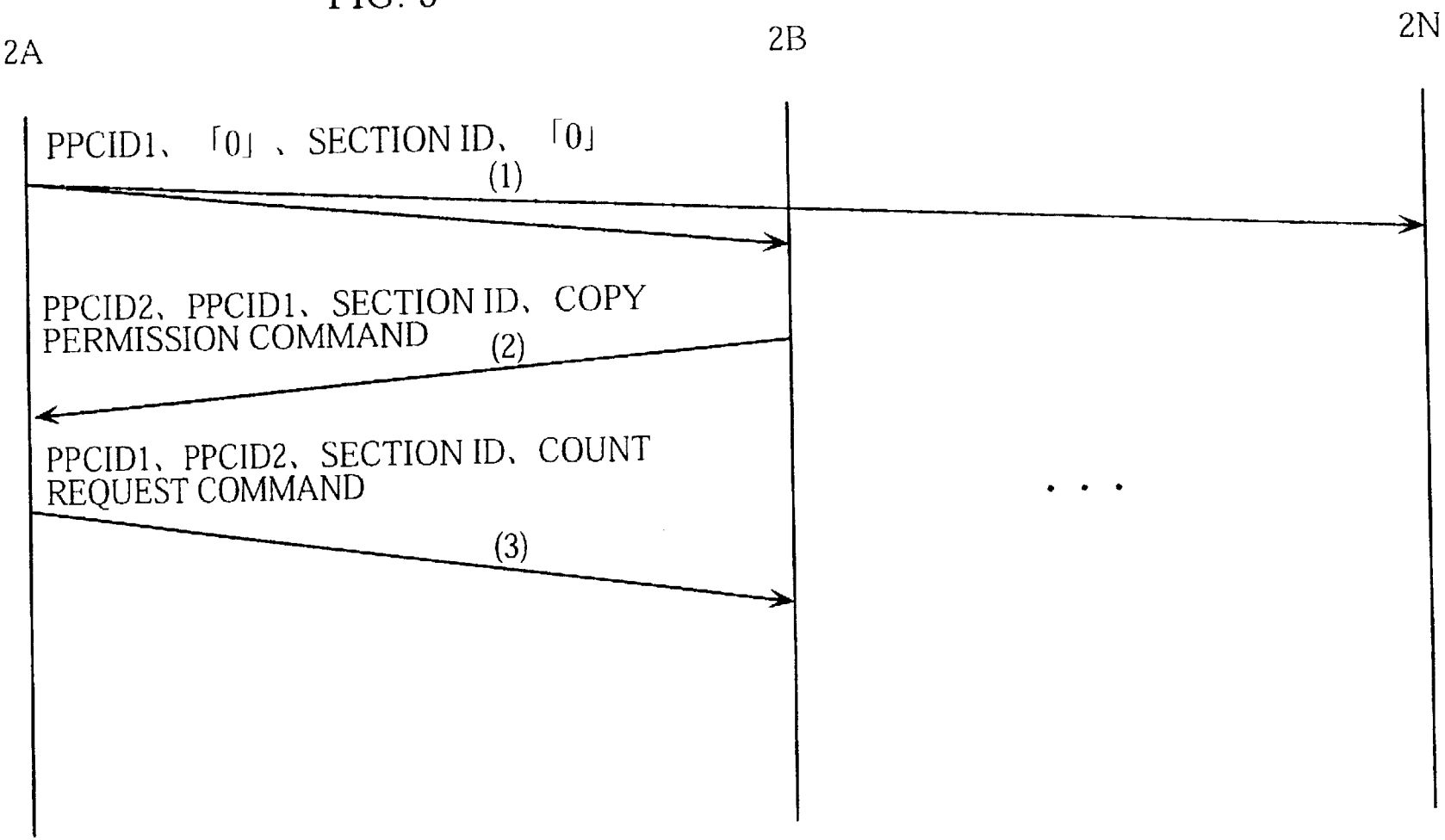
FIG. 5 is a sequence diagram showing the communication between copying machines.

FIG. 5 is a sequence diagram showing the data communication performed among a plurality of copying machines. The inquiry stage (1) is performed only when a section ID inputted by the user does not exists in the supervisory table T of the present copying machine. In this stage, the copying machine 2-1, to which the user has inputted to the section ID, transmits data "PPCID1" representing the inquirer, data "0" representing its destination, the subject section ID, and a command "0", to the other copying machine-s 2-2 to 2-n (hereinafter, a copying machine which inquires of other copying machines as to section IDs will be referred to as "an inquirer copying machine").

The destination data value "0" indicates that the destination is a plurality of copying machines and not specified, while the command "0" indicates a request for an inquiry as to whether the inputted section ID is identical to any registered section ID.

Each of the copying machines 2-2 to 2-n that have received an inquiry request searches registered section IDs stored in itself for the inputted section Id.

The response stage (2) is performed when the inquired section ID exists in the supervisory table T of the copying machine. In FIG. 5, the inquired section ID exists in the copying machine 2-2.

To the inquirer copying machine 2-1, the copying machine 2-2 transmits its machine ID "PPCID2", the copying machine 2-1 machine ID "PPCIDl" representing the destination, the inquired section ID, and a copy permission command indicating that the user is allowed to use the copying machine 2-1 (hereinafter, a copying machine which responds to an inquirer copying machine with a command, such as a copy permission command will be referred to as a respondent copying machine).

A copying machine in which the inquired section ID is not registered does not respond to the inquiry from the copying machine 2-1. The data terminal control unit 200B of the copying machine 2-1 switches the copy operation status from "prohibited" to "permitted", and informs the operation panel control unit 200A that users with the section ID, which is not registered in the copying machine 2-1, should be allowed to use the machine.

The copy number informing stage (3) is performed to inform the respondent copying machine of the number of copies made by the copying machine 2-1. As shown in FIG. 5, the copying machine 2-1 transmits to the copying machine 2-2, the inquirer machine ID "PPCID1", the respondent machine ID "PPCID2" representing the destination, the inquired section ID, and a count request command indicating the number of copies made by the copying machine 2-1.

The data terminal control unit 200B counts the number of copies made by the users with the registered section ID upon receipt of a count request command from the copying machine 2-1. Such a count request command includes information about sheet size so that the respondent copying machine can count the number of copies of each size made by the users with the section ID.

Referring to the flowcharts of FIGS. 6 to 12, the following is an explanation of the processes performed by the CPUs 201 and 211 of each control unit when the user inputs the section ID to one of the copying machines 2-1 to 2-n before going through the above three stages.

Figure 6:
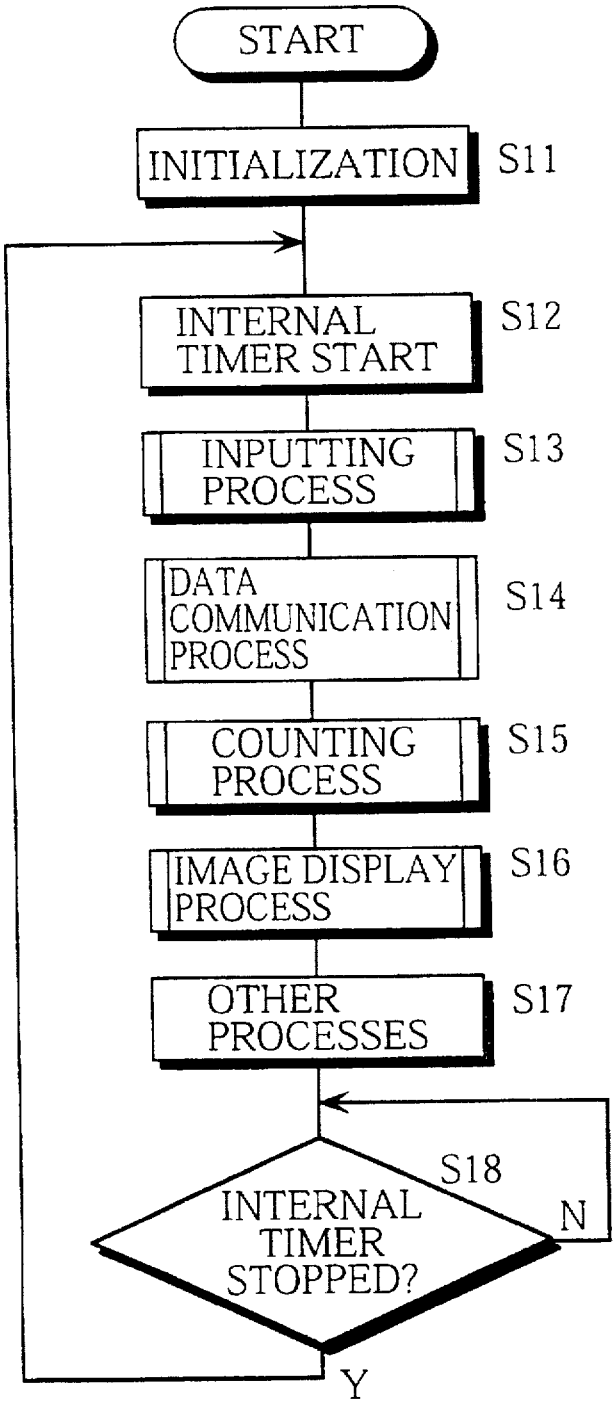
FIG. 6 is a flowchart showing the procedure in the main routine executed by CPU 201 and CPU 211.

FIG. 6 shows the procedure in the main routine executed by the CPU 201 and the CPU 211.

Upon switching on the copying machine, the CPU 211 of the data terminal control unit 200B performs initialization of the work area of the S-RAM 213 and others (step S11). The internal timer is then started (step S12), and it repeatedly supervises the processes of steps S12 to S18 performed in a predetermined period of time (step S18).

This repeating loop includes an input process in which various kinds of key input are received from the operation panel OP (step S13) , a data communication process in which the. copying machine communicates with the host computer 1 and other copying machines (step S14), the counting process in which the number of copies made by a user is counted (step S15) , an image display process for the operation panel OP (step S16), and other processes, such as confirming the existence of copying sheets in the sheet cassettes (step S17).

Figure 7:
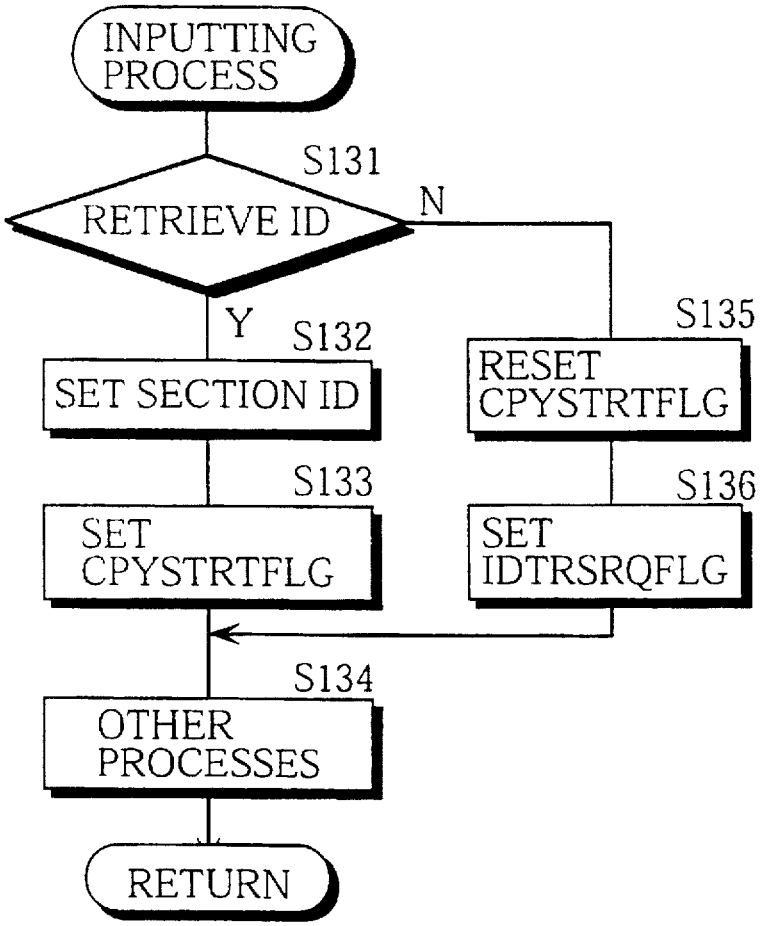
FIG. 7 is a flowchart showing the inputting subroutine in step S13 of FIG. 6.

FIG. 7 is a flowchart showing the inputting process in step S13 of FIG. 6.

Upon switching on the copying machine, the CPU 201 reads the image data of the section supervision display mode from the NV-RAM 204. According to the image data, the liquid crystal touch panel 91 displays the section supervision image (shown in FIG. 2A). Guided by the image, a user inputs his/her section ID from the operation OP. The CPU 201 then receives the section ID and informs the CPU 211.

After receiving the section ID information from the CPU 201, the CPU 211 judges whether the section ID is identical to one of the registered IDs by searching the supervisory table T for the same ID (step S131). If the inputted section ID is equal to one of the registered IDs, it is set in the section ID buffer IDB shown in FIG. 4B (step S132), the copy permission flag CPYSTRTFLG is set to "1" (step S133), and the other processes, such as informing the CPU 201 that the inputted section ID from the operation panel OP is identical to a registered section ID and therefore copying is permitted, are performed (step S134).

After receiving the copy permission information from the CPU 211, the CPU 201 read the data of standard display mode from the NV-RAM 204 and controls the liquid crystal touch panel 91 so as to display the standard display image (shown in FIG. 2B) , so that various copying conditions, such as the number of copies to be made, magnification, sheet size, and density, can be set from the liquid crystal touch panel 91. By pressing the start key 96, the image reader control unit 200C and the printer control unit 200D are instructed to perform a copying operation under the conditions set from the liquid crystal touch panel 91.

If the inputted section ID is not identical to a registered ID, the CPU 211 resets the copy permission flag CPYSTRTFLG to "0" (step S135), sets the ID transmission request flag IDTRSRQFLG to "1" in order to advance to an inquiry stage (1) (step S136) , and performs other processes, such as informing the CPU 201 from the operation panel OP that the inputted section ID is not identical to a registered ID and therefore copying is not permitted (step S134).

Figure 8:
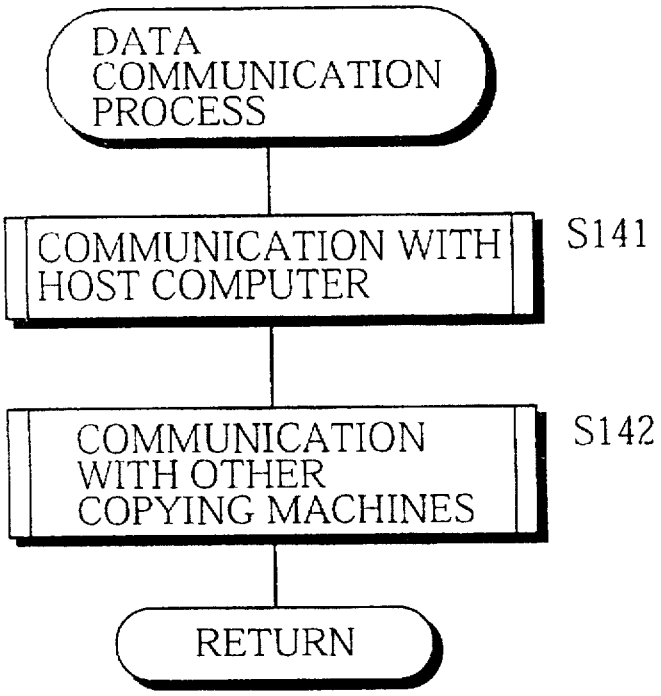
FIG. 8 is a flowchart showing the data communication subroutine in step S14 of FIG. 6.

FIG. 8 shows the data communication process in step S14 of FIG. 6. In this process, the present copying machine communicates with the host computer 1 (step S141), and it also communicates with other copying machines (step S142). In the communication with the host computer 1 in step 141, various kinds of data (data for maintenance, count data for calculating cost, for instance) from each of the copying machines 2-1, 2-2, . . . 2-n are transmitted to the host computer 1.

Figure 22:
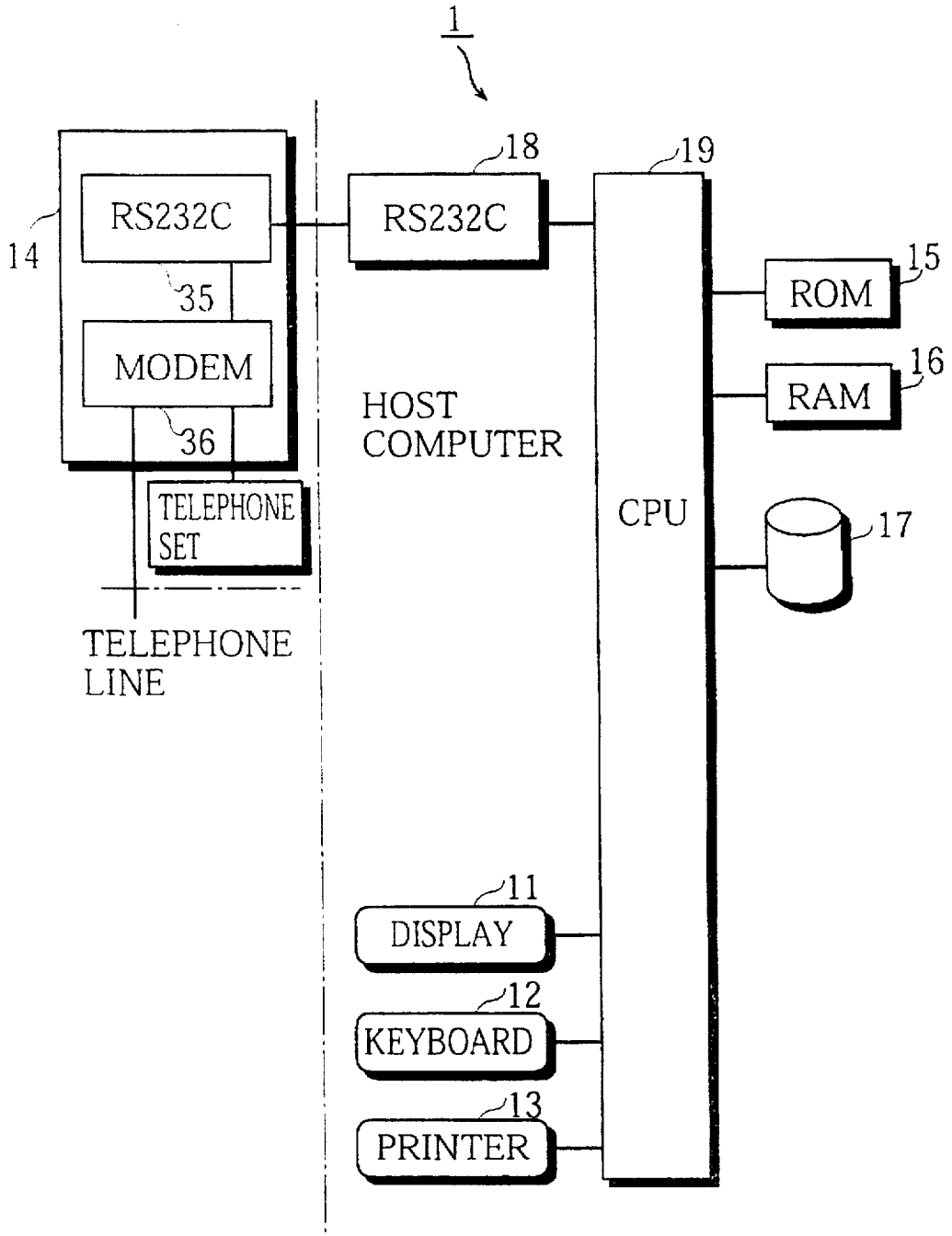
FIG. 22 is a block diagram showing the structure of a host computer 1.

As shown in FIG. 22, the host computer 1 is structured around the CPU 19, comprising a ROM 15 for storing programs, a RAM 16 to be used as a work area, a hard disc 17 for storing the various kinds of data from each of the copying machines, and a communication interface 18 (RS232C interface). The host computer 1 communicates with the copying machines through the modem unit 14 consisting of an RS232C interface 35 and a modem 36, and also prints out and display the various data held by the hard disc 17. According to the printouts and displays, clerks at the service center issue bills and maintain each copying machine.

Figure 9:
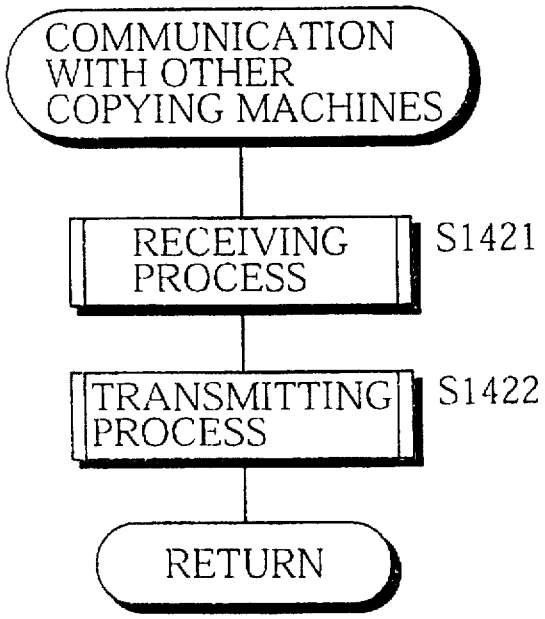
FIG. 9 is a flowchart showing the copying machine communication subroutine in step S142 of FIG. 8.

FIG. 9 shows the communication process with other copying machines in step S142 of FIG. 8. This process is made up of a receiving process (step S1421) and a transmitting process (step S1422).

Figure 10:
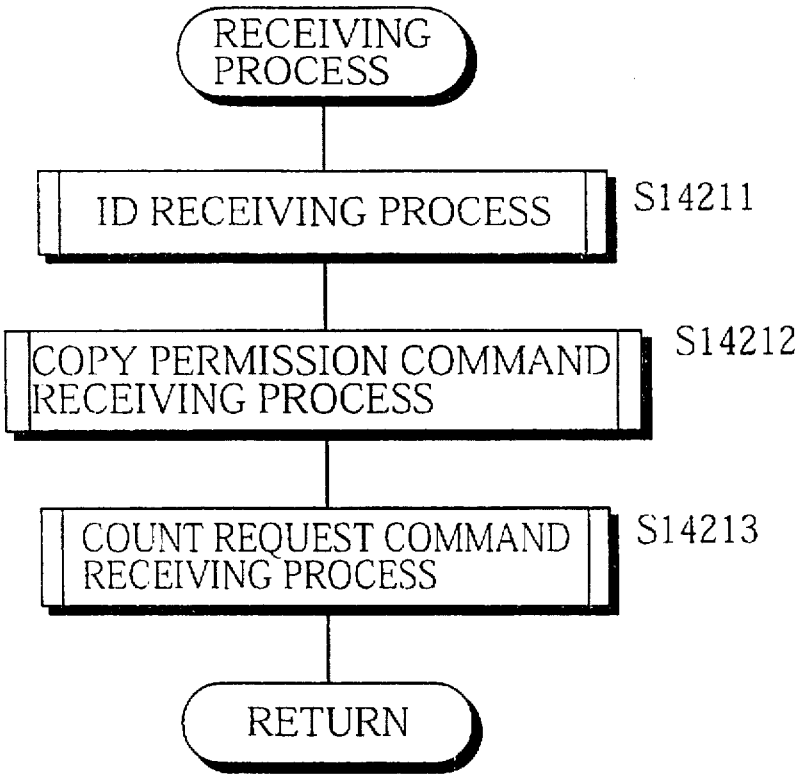
FIG. 10 is a flowchart showing the receiving subroutine in step S1421 of FIG. 9.

FIG. 10 shows the receiving process in step S1421 of FIG. 9. This process is made up of an ID receiving process of receiving the machine IDs and section IDs of other copying machines (step S14211), a copy permission command receiving process (step S14212), and a count request command receiving process (step S14213).

Figure 11:
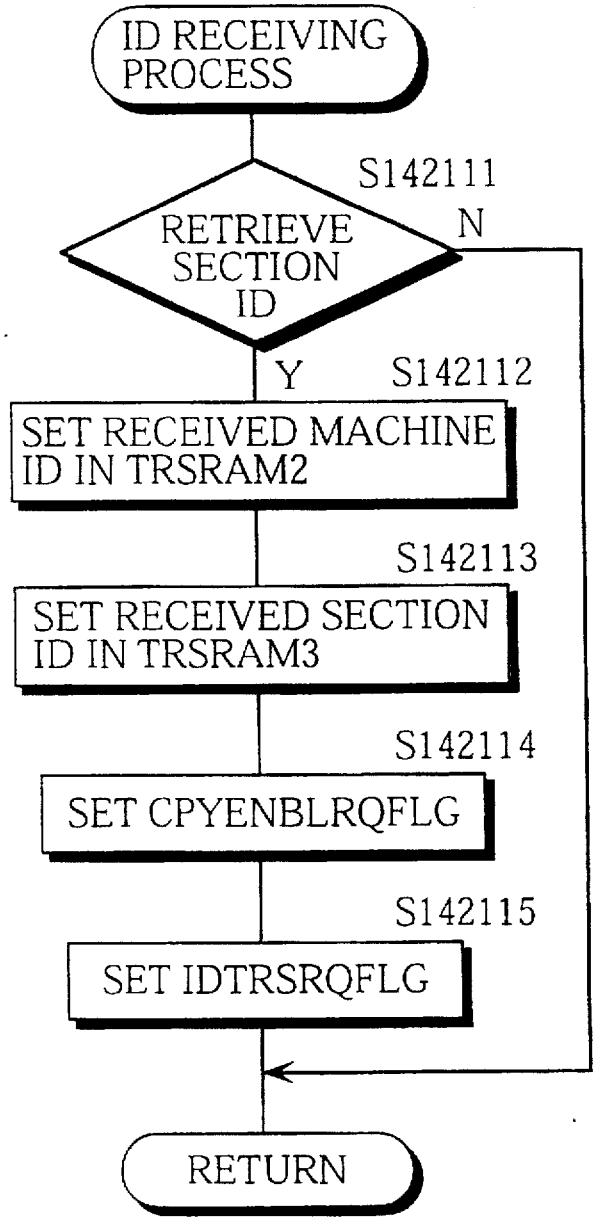
FIG. 11 is a flowchart showing the ID receiving subroutine in step S14211 of FIG. 10.

FIG. 11 shows the ID receiving process in step S14211 of FIG. 10. This process is performed by the CPU 211 of the recipient copying machine in the inquiry stage (1). More specifically, the CPU 211 reads the contents stored in the reception buffer RB to judge whether a registered ID identical to a section ID received from another copying machine exists in the supervisory table T of the present copying machine (step S142111). If there exists a corresponding section ID, the CPU 211 stores the received machine ID into the destination storage area TRSRAM2 so as to advance to the response stage (2) (step S142112) , stores the received section ID into the section ID storage area TRSRAM3 (step S142113), sets the copy permission transmission request flag CPYENBLRQFLG to "1" (step S142114), and sets the ID transmission request flag IDTRSRQFLG to "1" (step S142125).

If no registered section ID identical to the received section ID can be found in the supervisory table T of the present copying machine in step S142111, there is no need to respond to the inquirer copying machines, and thus the CPU 211 terminates the subroutine.

Figure 12:
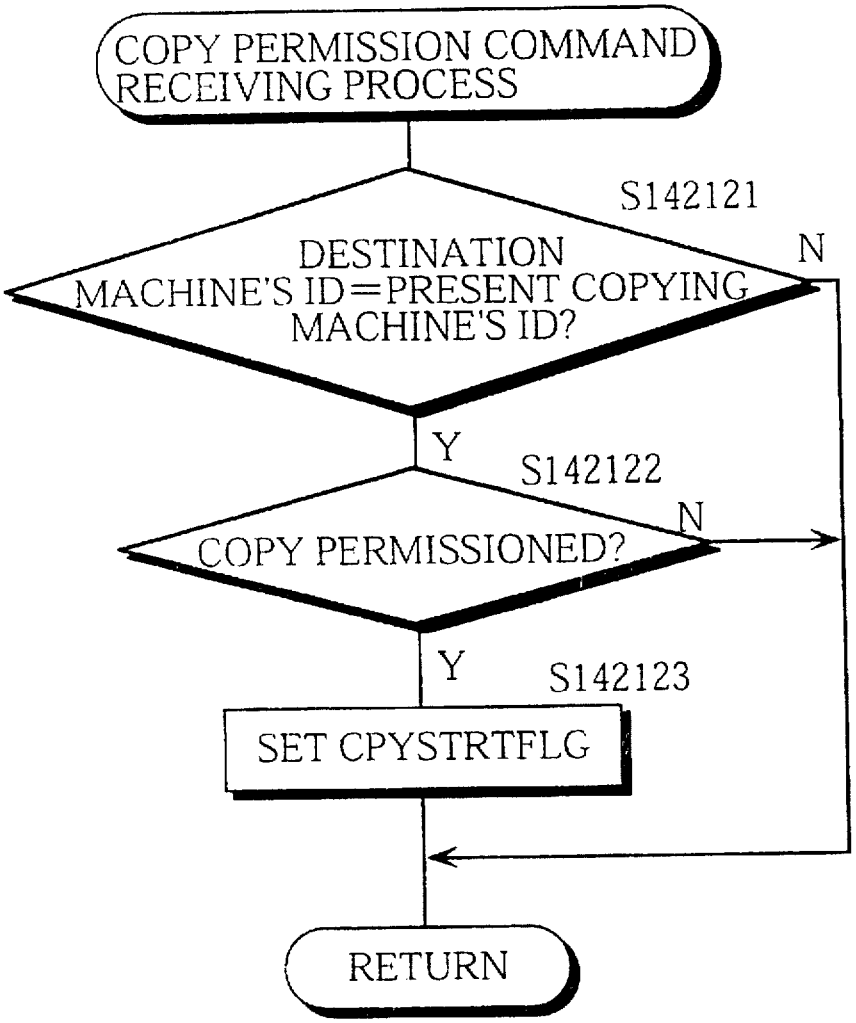
FIG. 12 is a flowchart showing the copy enable command receiving subroutine in step S14212 of FIG. 10.

FIG. 12 shows the copy permission command receiving process in S14212 of FIG. 10. This processing is performed by the CPU 211 of an inquirer copying machine in the response stage (2). The CPU 211 reads the content of the reception buffer RB, and judges whether the destination machine ID from the respondent copying machine is identical to the machine ID of the present copying machine (step S142121).

If the destination machine ID from the respondent copying machine is identical to the machine ID of the present copying machine, the CPU 211 judges whether a copy permission command is included (step S142122). If a copy permission command is included, the copy permission flag CPYSTRTFLG is set to "1" to switch the operation status from "no copy" to "copy O.K." (step S142123).

If the destination machine ID is judged not to be equal to the machine ID of the present copying machine in step S142121, or if a copy permission command is judged not to be included in step S142122, any other copying machine does not have a registered section ID identical to the inputted section ID, and therefore the CPU 211 terminates the subroutine.

Figure 13:
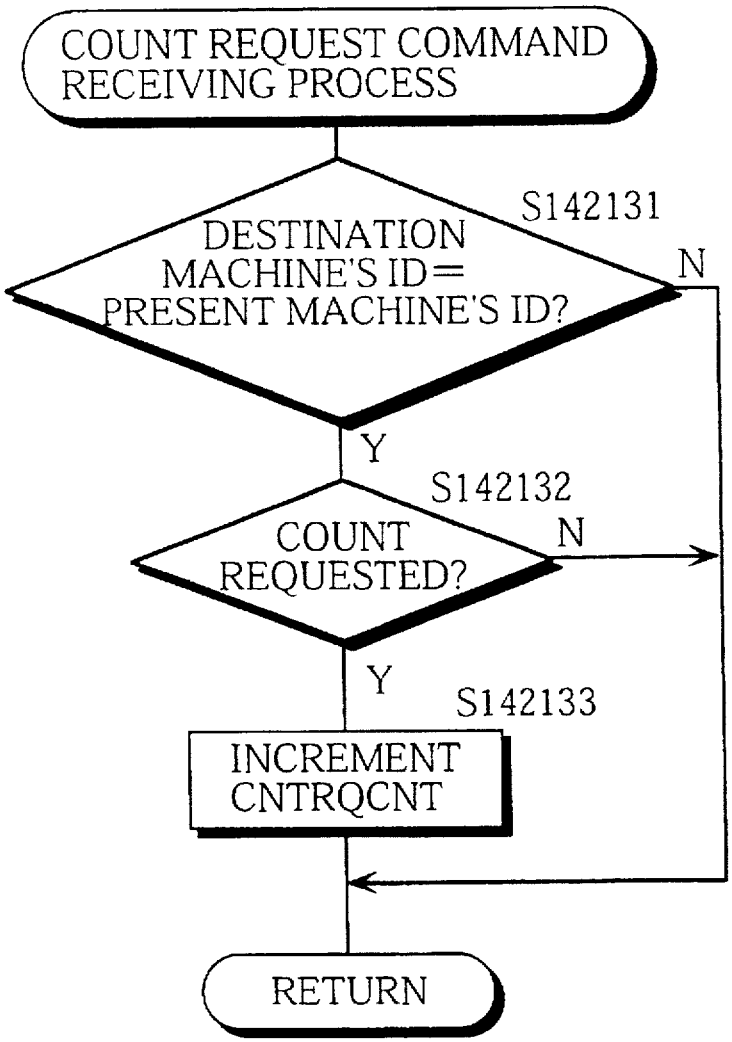
FIG. 13 is a flowchart showing the count request command receiving subroutine in step S14213 of FIG. 10.

FIG. 13 shows the count request command receiving process in S14213 of FIG. 10. This receiving process is performed by the CPU 211 of a respondent copying machine in the copy number informing stage (3). The CPU 211 reads the content of the reception buffer RB to judge whether the destination machine ID received from the inquirer copying machine is equal to the machine ID of the present copying machine (step S142131). If the destination machine ID is identical to the machine ID of the present copying machine, the CUP 211 judges whether a count request command is included (step S142132). If a count request command is included, the present copying machine counts the number of copying times by the present section through other copying machine, and therefore the count request counter CNTRQCNT is incremented (step S142133).

If the received destination machine ID is judged not to be equal to the machine ID of the present copying machine in step S142131, or a count request command is judged not to be included in step S142132, no copies have been made under the name of the present section through any other copying machine, and therefore the CPU 211 terminates the subroutine.

Figure 14:
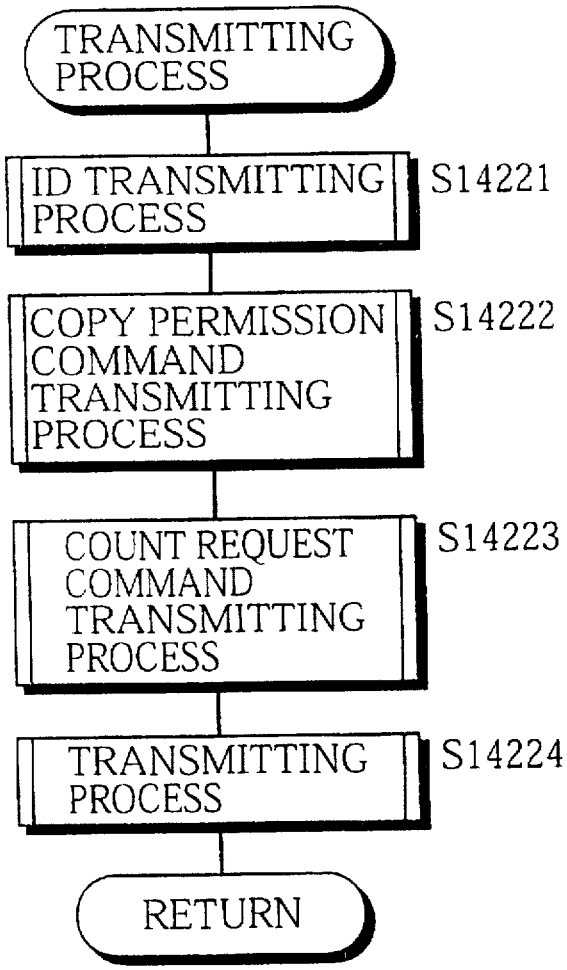
FIG. 14 is a flowchart showing the transmitting subroutine in step S1422 of FIG. 9.

FIG. 14 shows the transmitting process in step S1422 of FIG. 9. This transmitting process includes an ID transmitting process of transmitting the machine ID of the present copying machine, section IDs, and the like (step S14221), a copy permission command transmitting process (step S14222), a count request command transmitting process (step S14223), and transmitting process of transmitting any of the above results to other copying machines (step S14224)

Figure 15:
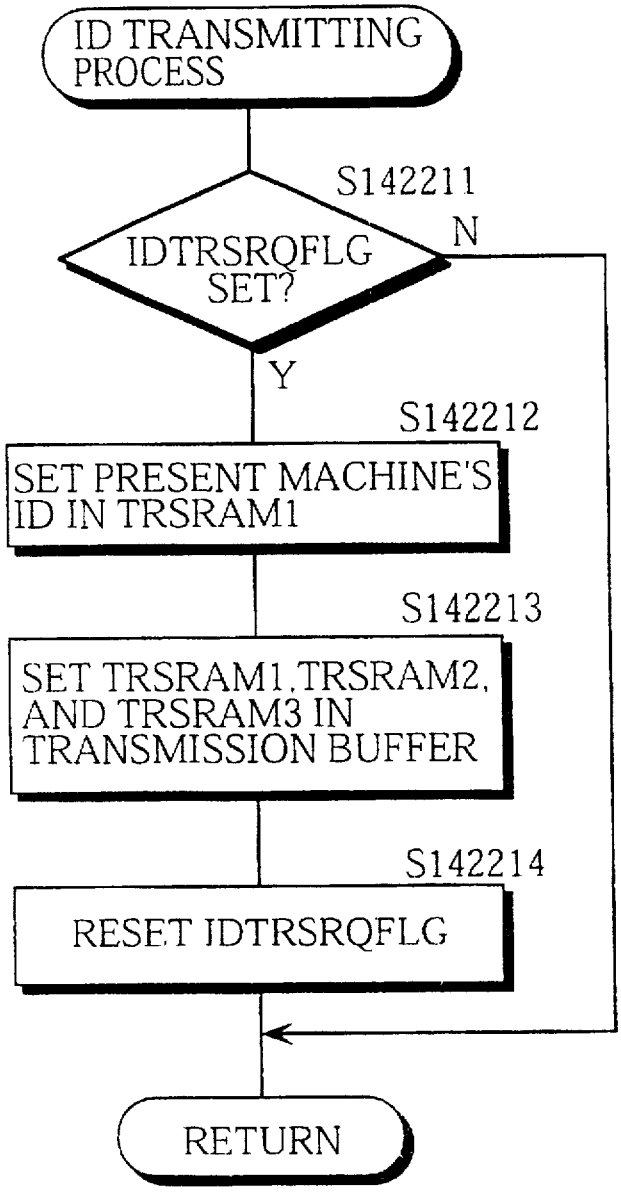
FIG. 15 is a flowchart showing the ID transmitting subroutine in step S14221 of FIG. 14.

FIG. 15 shows the ID transmitting process in step S14221 of FIG. 14. This ID transmitting process is performed by the CPU 211 of the transmission copying machine upon execution of the inquiry stage (1), the response stage (2), and the copy number informing stage (3).

The CPU 211 of the transmission copying machine first judges whether the ID transmission request flag IDTRSRQFLG is "1" (step S142211). If it is, the machine ID of the present copying machine is stored into the transmitter storage area TRSRAM1 (step S142212), the contents of the transmitter storage area TRSRAM1, the destination storage area TRSRAM2, and the section ID storage area TRSRAM3 are stored in the transmission buffer TRB (step S142213), and then the ID transmission request flag IDTRSRQFLG is reset (step S142214).

In the inquiry stage (1) the content of the destination storage area TRSRAM2 is "0", indicating inquiries of all the other copying machines. The content of the section ID storage area TRSRAM3 indicates the inquired section ID.

If the ID transmission request flag IDTRSRQFLG is not "1" in step S142211, the CPU 211 terminates the subroutine in order to prepare for the response stage (2) and the copy number informing stage (3).

Figure 16:
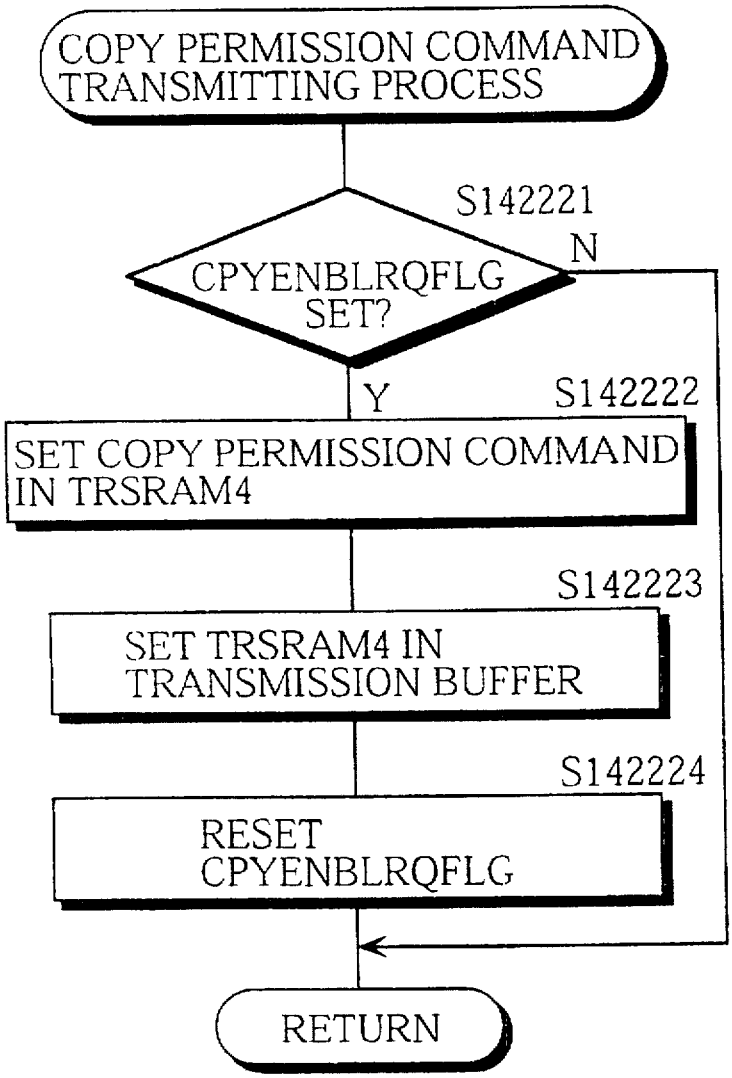
FIG. 16 is a flowchart showing the copy permission command transmitting subroutine in step S14222 of FIG. 14.

FIG. 16 shows the copy permission command transmitting process in step S14222 of FIG. 14. This transmitting process is performed by the CPU 211 of the respondent copying machine in the response stage (2). Firstly, the CPU 211 judges whether the copy permission transmission request flag CPYENBLRQFLG is "1" (step S142221). If it is, the CPU 211 stores a copy permission command into the command storage area TRSRAM4 so as to give a copy permitting response to the inquirer copying machine (step S142222) , stores the content of the command storage area TRSRAM4, i.e., a copy permission command, into the transmission buffer TRB (step S142223), and the copy permission transmission request flag CPYENBLRQFLG is reset (step S142224).

In this response stage (2), the machine ID of the present copying machine is stored in the transmitter storage area TRSRAM1 in step S142212 of FIG. 15, the received machine ID of another copying machine is stored in the destination storage area TRSRAM2 in step S142112, and the received section ID is stored in the section ID storage area TRSRAM3 in step S142113.

If the copy permission transmission request flag CPYENBLRQFLG is not "1" in step S142221,the CPU 211 terminates the subroutine so as to prepare for the copy number informing stage (3).

Figure 17:
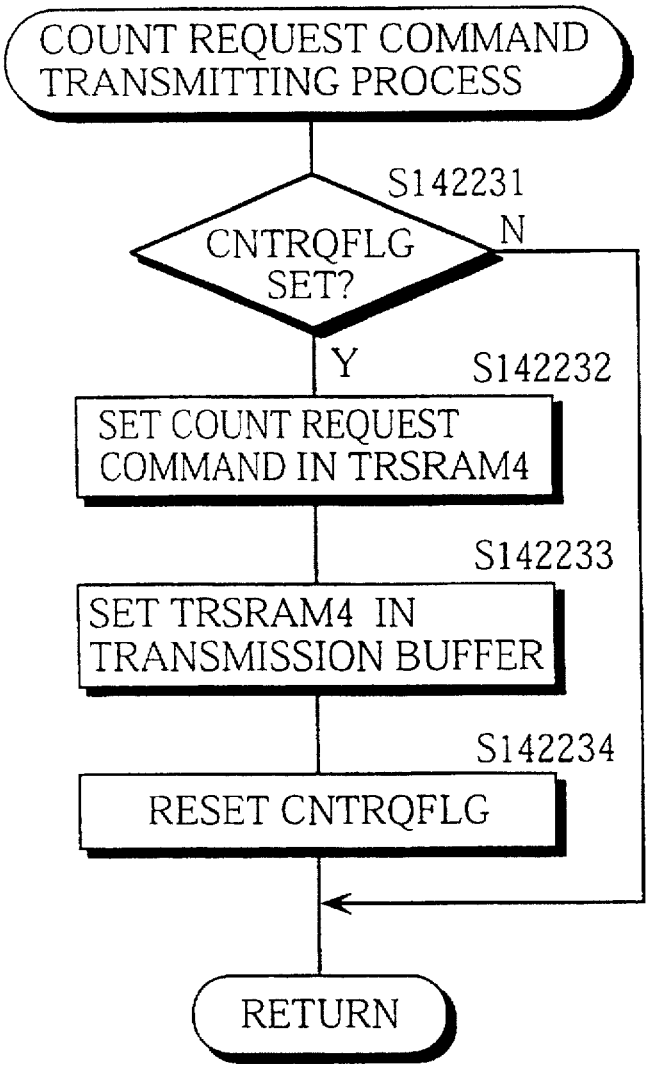
FIG. 17 is a flowchart showing the count request command transmitting subroutine in step S14223 of FIG. 14.

FIG. 17 shows the count request command transmitting process in step S14223 of FIG. 14. This transmitting process is performed by the CPU 211 of the inquirer copying machine in the copy number informing stage (3). Firstly, the CPU 211 judges whether the count request flag CNTRQFLG, which is mentioned later (in step S1533 of FIG. 20), is "1" or not (step S142231).

If the count request flag is "1", the CPU 211 stores a count request command into the command storage area TRSRAM4 (step S142232), stores the content of the TRSRAM4 into the transmission buffer TRB (step S142233), and then resets the count request flag CNTRQFLG (step S142234).

If the count request flag CNTRQFLG is not "1" in step S142231, the CPU 211 terminates the subroutine.

In the transmitting process in step S14224 of FIG. 14, the contents stored into the transmission buffer TRB in the subroutines of steps S14221 to S14223 are transmitted to respondent copying machines.

More specifically, in the case where steps S142211 to S142214 of FIG. 15 are performed while steps S142222 to S142224 of FIG. 16 and steps S142232 to S142234 of FIG. 17 are skipped, the CPU 211 activates the modem unit 21 to perform the inquiry stage (1) by transmitting the machine ID of the inquirer of the contents of the transmission buffer TRB, the destination machine ID "0", the section ID, and no commands.

In the case where steps S142211 to S142214 of FIG. 15 and steps S142221 to S142224 of FIG. 16 are performed while steps S142232 to S142234 of FIG. 17 are skipped, the CPU 211 activates the modem 21 to perform the response stage (2) by transmitting the machine ID of the inquirer of the contents of the transmission buffer TRB, the destination ID, the section ID, and a copy permission command.

In the case where steps S142211 to S142214 of FIG. 15 and steps S142231 to S142234 of FIG. 17 are performed while steps S142222 to S142224 of FIG. 16 are skipped, the CPU 211 activates the modem unit 21 to perform the copy number informing stage (3) by transmitting the machine ID of the inquirer of the contents of the transmission buffer TRB, the destination ID, the section ID, and a count request command.

In the case where the section ID inputted from the present copying machine is a section ID registered with the present copying machine, or where the section ID sent from another copying machine is not a section ID registered with the present copying machine, the CPU 211 skips steps S142212 to S142214 of FIG. 15, steps S142222 to S142224 of FIG. 16, and steps S142232 to S142234 of FIG. 17, and therefore the content of the transmission buffer TRB remains "0". In such a case, the CPU 211 skips the transmitting process in step S14224.

Figure 18:
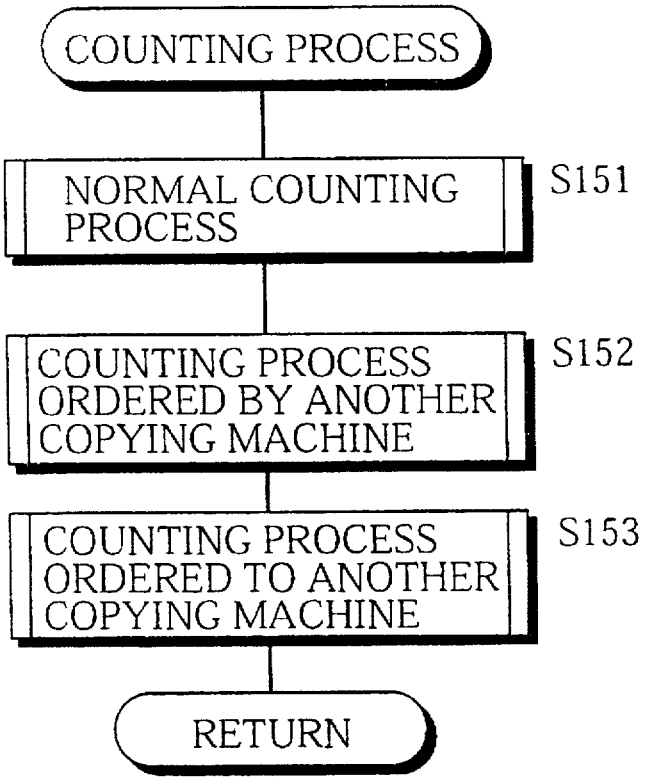
FIG. 18 is a flowchart showing the counting subroutine in step S15 of FIG. 6.

FIG. 18 shows the counting process in S15 of FIG. 6. This counting process is made up of a normal copy number counting process performed when the present copying machine has a registered section ID identical to the inputted section ID, and copying by the present copying machine is permitted (step S151), a copy number counting process performed when a count request command is received from another copying machine (step S152), and a copy number counting process performed when a count request command is sent to another copying machine (step S153).

In the normal counting process in step S151, copies are made by the present copying machine having the inputted section ID. Here, the CPU 201 informs the CPU 211 each time a copy is made, and the CPU 211 increments the number of copies made in the present section for each of sheet types shown in the supervisory table T.

Figure 19:
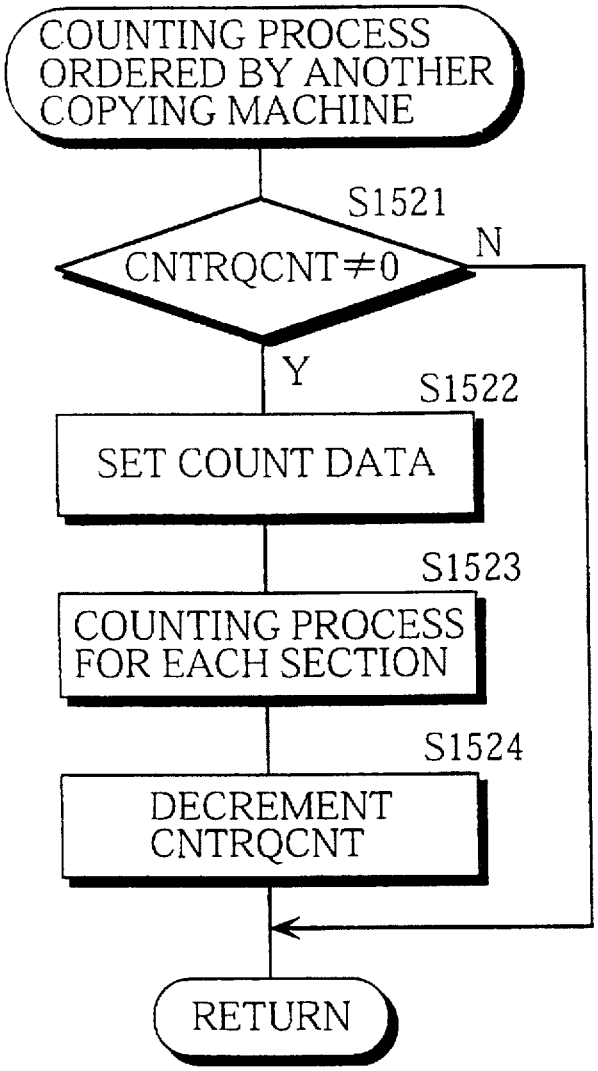
FIG. 19 is a flowchart showing the counting process ordered by another copying machine in step S152 of FIG. 18.

FIG. 19 shows the counting process ordered by another copying machine in step S152 of FIG. 18. Since the CPU 211 increments the value of the count request counter CNTRQCNT each time a count request command is sent from another copying machine, i.e., an inquirer copying machine (step S142133 of FIG. 13), the value of the count request counter CNTRQCNT indicates the number of copies made by other copying machines. In this subroutine, the number of copies made in each section is accumulatively counted according to the value of the count request counter CNTRQCNT.

More specifically, the CPU 211 judges whether the value of the count request counter CNTRQCNT is "0" (step S1521). If it is not, the value is set as the count data (step S1522), the number of copies made in each corresponding relevant section contained in the supervisory table T is incremented by the value of the count request counter CNTRQCNT (step S1523), and the value of the count request counter CNTRQCNT is decremented by the incremented value (step S1524).

If the value of the count request counter CNTRQCNT is "0" in step S1521, the user having the registered section ID of the present copying machine has not made a copy by another copying machine. Here, the CPU 211 terminates the subroutine.

Figure 20:
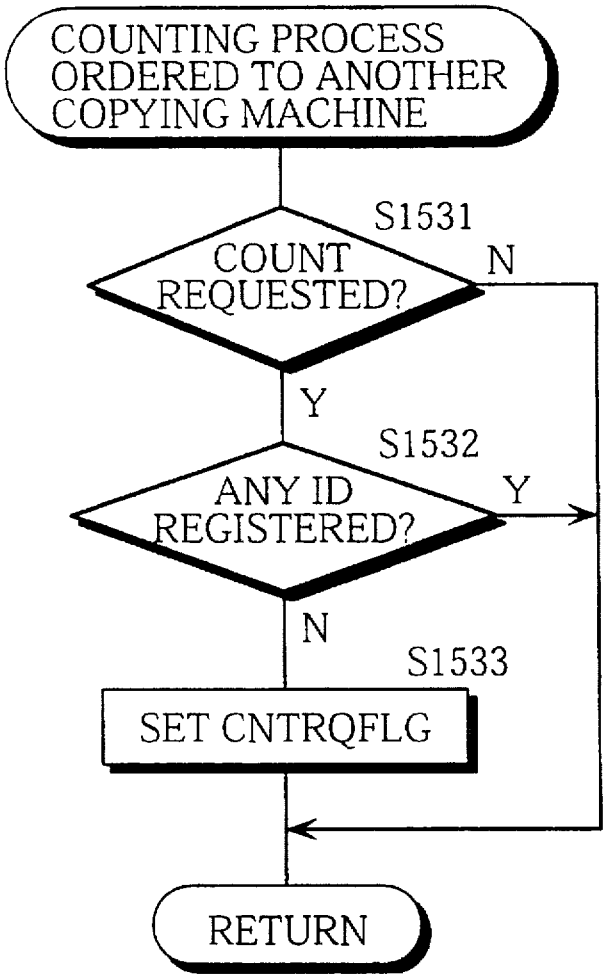
FIG. 20 is a flowchart showing the counting process ordered to another copying machine in step S153 of FIG. 18.

FIG. 20 shows the counting process ordered to another copying machine shown in step S153 of FIG. 18.

Firstly, the CPU 211 judges whether a count request has been made (step S1531). If there is a count request, the CPU 211 judges whether the received section ID is registered with the present copying machine (step S1532). If the received section ID is not a registered section ID, the CPU 211 informs another copying machine having a registered section ID identical to the received section ID, i.e., a respondent copying machine, of the number of copies made by the present copying machine. The CPU 211 then sets the count request command flag CNTRQFLG to "1" so that the number of copies is invariably counted by the respondent copying machine (step S1533). The status of the count request command flag is judged in step S142231 of FIG. 17, as mentioned above, to prepare or the transmission of a count request command to another copying machine.

If there is no count request in step S1531, or the received section ID is judged to be registered with the present copying machine itself, the CPU 211 terminates the subroutine.

Figure 21:
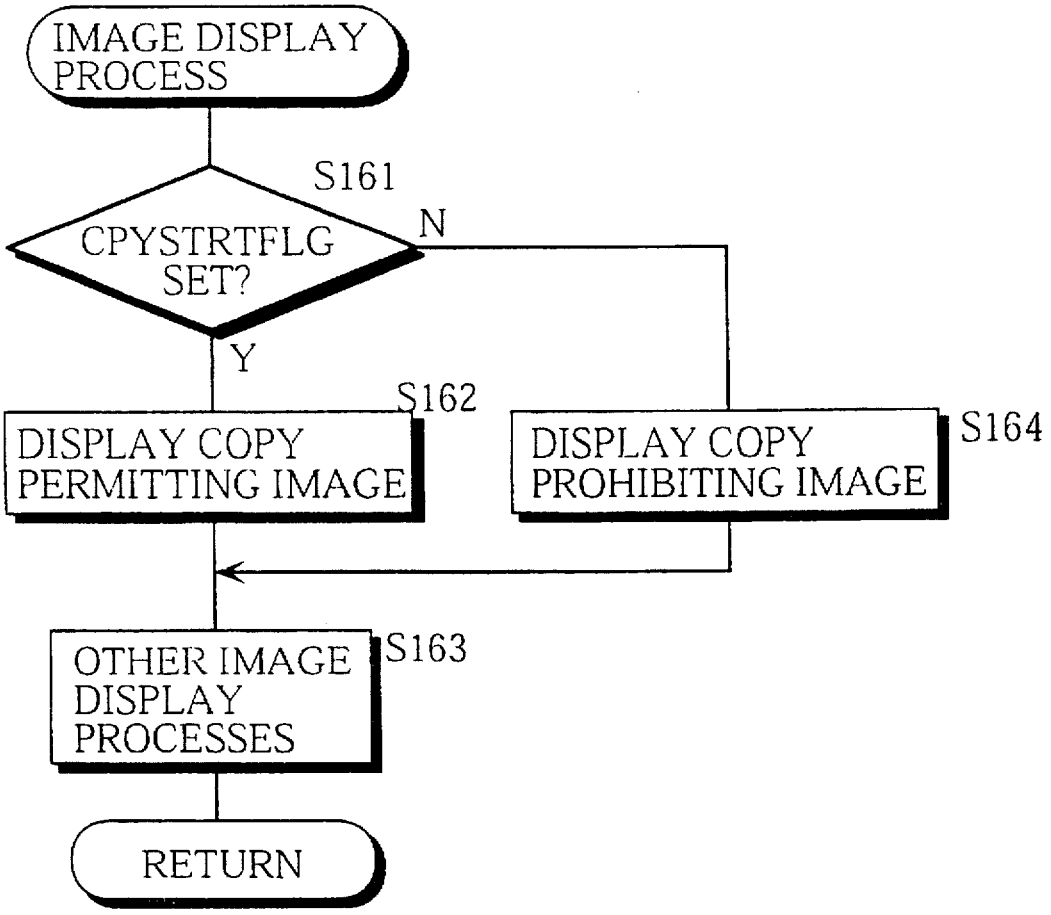
FIG. 21 is a flowchart showing the image display subroutine in step S16 of FIG. 6.

FIG. 21 shows the image display process in step S16 of FIG. 6. In this subroutine, the CPU 211 judges whether the copy permission flag CPYSTRTFLG is "1" (step S161). If it is, the CPU 211 informs the CPU 201 that copying is allowed. Upon receipt of this information, the CPU 201 performs display processing on the copy permitting image shown in FIG. 2B (step S162). Other display processes are also performed (step S163). For instance, by pressing the sheet button TP1 on the liquid crystal touch panel 91 in the standard display image shown in FIG. 2B, a list of sheet sizes stored in the NV-RAM 204 is displayed in the standard display image in accordance with the panel display program stored in the EP-ROM 202.

If the copy permission flag CPYSTRTFLG is not "1" in step S161, the CPU 211 informs the CPU 201 that copying is prohibited. Upon receipt of the copy prohibition information, the CPU 201 performs copy prohibiting image display processing (step S164), instead of displaying the copy permitting image. For instance, the CPU 201 reads the data of section supervision display mode from the NV-RAM204, and instructs the liquid crystal touch panel 91 to display the message, "Your section ID is not recognized. Please try again."

Other image display processes are performed (step S163). For instance, after a certain period of time, the display image on the liquid crystal touch panel returns to the initial section supervisory display image shown in FIG. 2A so as to receive a section ID.

As described so far, according to the embodiment of the present invention, the CPUs 201 and 211 of the copying machines 2-1 to 2-n perform the stages shown in FIG. 5 according to the flowcharts of FIGS. 6 to 21. Thus, it is not necessary to register a section ID in each copying machine to be used, and copying can be performed as long as the section ID is registered in any one of the copying machines.

Also, the number of sections can be increased by installing more copying machines without increasing the amount of memory of each copying machine. Since the information about the number of copies is sent to a copying machine having a section ID under which copies are made, copying operations in a section can be invariably supervised by a copying machine having the section ID of the section. Thus, the counting process can be made easier.

In stead of a copy permission command, a respondent copying machine may issue a response so as to inform that the inquired section ID is identical to a registered ID of the copying machine.

In the above embodiment, an inquirer copying machine transmits a count request command each time a copy is made after receiving a response to allow copying from the destination copying machine, and the number of copies is counted each time the respondent copying machine receives a count request command, but the inquirer copying machine may count the number of copies and transmit the total number to the respondent copying machine.

The respondent copying machine may respond to the inquiry copying machine with a copy permission command and the number of copies made so far in the section having the corresponding section ID. The inquiry copying machine adds the number of copies made by itself to the number received from the respondent copying machine, and then transmits the addition result to the respondent copying machine.

By doing so, the respondent copying machine does not need to count the total number of copies. It only stores the number of copies received from the inquiry copying machine, which has made the copies, in relation to the corresponding section ID. Thus, the counting in the respondent copying machine c an be easier.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:

an identifier receiving unit for receiving a first user identifier inputted by a user;

an identifier storage unit for storing a first registered identifier under which image forming operations are permitted;

a judging unit for permitting the user to use the image forming apparatus if the first user identifier inputted by the user is identical to the first registered identifier stored in the identifier storage unit, and prohibiting the user from using the image forming apparatus if the first user identifier is not identical to the first registered identifier;

a communication unit for communicating with another image forming apparatus;

an inquiry unit for making a first inquiry, via the communication unit, as to whether the first user identifier is identical to a second registered identifier of another image forming apparatus, if the first user identifier is not identical to the first registered identifier; and a switching unit for switching the judging unit from "prohibition" to "permission" if another image forming apparatus has informed that the first user identifier is identical to the second registered identifier, or that the user is permitted to use the image forming apparatus that has made the first inquiry.

2. An image forming apparatus according to claim 1, further comprising:

a receiving unit for receiving a second inquiry from another image forming apparatus, via the communication unit, as to whether a second user identifier inputted to said another image forming apparatus is identical to the first registered identifier;

a searching unit for searching the identifier storage unit of the image forming apparatus for the second user identifier; and a transmitting unit for transmitting a response, via the communication unit, to the image forming apparatus that has made the second inquiry so as to inform that the second user identifier has been found, or that the user is permitted to use the image forming apparatus that has made the second inquiry when the second user identifier has been found in the identifier storage unit.

3. An image forming apparatus according to claim 2, further comprising:

a counting unit for counting how many times an image is formed by the image forming apparatus, which the user is permitted to use; and a count informing unit for informing, via the communication unit, another image forming apparatus having the second registered identifier identical to the first user identifier of the count value of the counting unit.

4. An image forming apparatus according to claim 3, further comprising:

a count storage unit for storing a count value indicating the number of times an image has been formed, in relation to the first registered identifier: and a count updating unit for updating the count value by adding a count value informed from another image forming apparatus in relation to the first registered identifier, if any, to the count value stored in the count storage unit.

5. An image forming apparatus according to claim 2, further comprising:

a counting unit for counting how many times an image is formed by the image forming apparatus, which the user is permitted to use;

a count receiving unit for receiving the number of times an image has been formed under the first user identifier from another image forming apparatus having the second registered identifier identical to the first user identifier, together with a response to the inquiry; and a count informing unit for adding the count value of the counting unit to the received number and informing another image forming apparatus, which has responded to the first inquiry, via the communication unit.

6. An image forming apparatus according to claim 5, further comprising:

a count storage unit for storing a count value indicating the number of times an image has been formed, in relation to the first registered identifier;

a count transmitting unit for transmitting, via the communication unit, the count value read from the count storage unit to another image forming apparatus that has made the second inquiry, together with a response to the second inquiry, the count value corresponding to the second registered identifier of said another image forming apparatus; and a count updating unit for replacing the count value related to the first registered identifier stored in the count storage unit with a count value informed from another image forming apparatus that has made the second inquiry.

7. An image forming apparatus comprising:

an identifier receiving unit for receiving a first user identifier inputted by a user;

an identifier storage unit for storing a first registered identifier under which image forming operations are permitted;

a first judging unit for permitting the user to use the image forming apparatus if the first user identifier is identical to the first registered identifier stored in the identifier storage unit, and prohibiting the user from using the image forming apparatus if the first user identifier is not identical to the first registered identifier;

a communication unit for communicating with another image forming apparatus;

an inquiry unit for making a first inquiry, via the communication unit, as to whether the first user identifier is identical to a second registered identifier of another image forming apparatus; and a second judging unit for permitting the user to use the image forming apparatus if another image forming apparatus has informed that the first user identifier is identical to the second registered identifier.

8. An image formation supervisory control system in which a plurality of image forming apparatuses are connected to each other over a network, each of the plurality of image forming apparatuses having a judging unit which compares a user identifier inputted by a user with a registered identifier stored in an identifier storage unit of the image forming apparatus beforehand, and which permits the user to use the image forming apparatus when the user identifier is identical to the registered identifier, and prohibits the user from using the image forming apparatus when the user identifier is not identical to the registered identifier, and the plurality of image forming apparatuses including at least a first image forming apparatus for inquiring of another image forming apparatus whether the user identifier is registered, and a second image forming apparatus for replying to the inquiry, characterized in that the first image forming apparatus comprises:

a first communication unit for communicating with the second image forming apparatus over the network;

an inquiry unit for inquiring of the second image forming apparatus, via the first communication unit, whether the inputted user identifier is identical to a registered identifier of the second image forming apparatus in the case where the judging unit has made a judgement that the inputted user identifier is not identical to the registered identifier of the first image forming apparatus; and a switching unit for switching the judgement of the judging unit to permitting an image forming operation in the case where the first image forming apparatus receives a response informing that the registered identifier of the second image forming apparatus is identical to the user identifier, or that the user is permitted to use the first image forming apparatus, and the second image forming apparatus comprises:

a second communication unit for communicating with the first image forming apparatus over the network;

a receiving unit for receiving an inquiry from the first image forming apparatus, via the second communication unit, as to whether the user identifier inputted to the first image forming apparatus is identical to the registered identifier of the second image forming apparatus;

a searching unit for searching the identifier storage unit of the second image forming apparatus for the inquired user identifier; and a transmitting unit for transmitting a response, via the second communication unit, to the first image forming apparatus to inform that the inquired user identifier is identical to the registered identifier of the second image forming apparatus, or that the user is permitted to use the first image forming apparatus.

9. An image formation supervisory control system according to claim 8, wherein the first image forming apparatus further comprises:

a counting unit for counting how many times an image is formed by the first image forming apparatus in the case where the user is permitted to use the first image forming apparatus; and a count informing unit for informing the count of the counting unit, via the first communication unit, to second image forming apparatus which has a registered identifier identical to the user identifier.

10. An image formation supervisory control system according to claim 9, wherein the second image forming apparatus further comprises:

a count storage unit for storing the number of times an image has been formed, in relation to a registered identifier; and a count updating unit for updating the count value by adding a count value informed from the first image forming apparatus, if any, to the count value stored in the count storage unit.

11. An image formation supervisory control system according to claim 8, wherein the first image forming apparatus further comprises:

a counting unit for counting how many times an image is formed by the first image forming apparatus in the case where the user is permitted to use the first image forming apparatus;

a count receiving unit for receiving the number of times an image has been formed under the user identifier, together with a response to the inquiry made by the inquiry unit; and a count informing unit for adding the count value of the counting unit to the received number and informing the second image forming apparatus having a registered identifier identical to the user identifier of the addition result via the first communication unit.

12. An image formation supervisory control system according to claim 11, wherein the second image forming apparatus further comprises:

a count storage unit for storing a count value in relation to a registered identifier;

a count transmitting unit for transmitting, via the second communication unit, the count value read from the count storage unit to the first image forming apparatus, the count value corresponding to the registered identifier of the second image forming apparatus; and a count updating unit for replacing the count value corresponding to the registered identifier stored in the count storage unit with a count value informed from the first image forming apparatus.

13. An image formation supervisory control method used in an image formation supervisory control system in which a plurality of image forming apparatuses are connected to each other over a network, each of the plurality of image forming apparatuses having a judging unit which compares a user identifier inputted by a user with a registered identifier stored in an identifier storage unit of the image forming apparatus beforehand, and which permits the user to use the image forming apparatus when the user identifier is identical to the registered identifier, and prohibits the user from using the image forming apparatus when the user identifier is not identical to the registered identifier, characterized by comprising the steps of:

(1) inquiring whether any other image forming apparatus has a registered identifier identical to a user identifier inputted to a first image forming apparatus, when the user identifier is not identical to the registered identifier of the first image forming apparatus;

(2) comparing the user identifier with a registered identified of a second image forming apparatus which has received the inquiry over the network;

(3) transmitting a response informing the first image forming apparatus that the user identifier is identical to the registered identifier of the second image forming apparatus or that the user is permitted to use the first image forming apparatus; and (4) switching the image forming status of the first image forming information to permitting image forming operations after the first image forming apparatus has received the response over the network.

14. An image formation supervisory control method according to claim 13, further including the step of (5) counting the number of times an image is formed by the first image forming apparatus in the case where the user is permitted to use the first image forming apparatus in the step (4), using a count storage unit provided in the second image forming apparatus for storing the number of times an image has been formed for each registered identifier.

15. An image formation supervisory control method according to claim 14, wherein the step (5) further includes the steps of:

(5-1) informing the second image forming apparatus of the number of times an image has been formed by the first image forming apparatus over the network; and (5-2) updating the count value by adding the informed count value to the count value stored in relation to a corresponding registered identifier in the count storage unit.

16. An image formation supervisory control method according to claim 14, wherein the step (5) further includes the steps of:

(5-1) informing, over the network, the first image forming apparatus of the number of times an image has been formed under the user identifier;

(5-2) informing, over the network, the second image forming apparatus of a count value calculated by adding the number of times an image has been formed by the first image forming apparatus to the count value informed from the second image forming apparatus; and (5-3) replacing the count value already stored in relation to the corresponding registered identifier in the second image forming apparatus with the informed addition result.

* * * * *

UNITED STATES PATENT AND TRADEMARK OFFICE

CERTIFICATE OF CORRRECTION

PATENT NO. : 5,784,664
DATED : July 21, 1998
INVENTOR(S) : Hidenobu Nakamura, et al.

It is certified that error appears in the above-identified patent and that said Letters Patent is hereby corrected as shown below:

On the title page item [56], insert the following:

FOREIGN PATENT DOCUMENTS

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | | 02- | 1 | 4 | 8 | 0 | 4 | 9 | 06/1990 | Japan | | | | |
| | | 06- | 3 | 2 | 6 | 7 | 3 | 3 | 11/1994 | Japan | | | | |
| | | 06- | 1 | 0 | 3 | 2 | 0 | 8 | 04/1994 | Japan | | | | |
| | | | | | | | | | | | | | | |

Signed and Sealed this

Twenty-seventh Day of April, 1999

*Attest:*

Q. TODD DICKINSON

*Attesting Officer*

*Acting Commissioner of Patents and Trademarks*